US009501929B2

(12) United States Patent
Sugawara

(10) Patent No.: US 9,501,929 B2
(45) Date of Patent: Nov. 22, 2016

(54) MOVEMENT ASSISTANCE DEVICE AND MOVEMENT ASSISTANCE METHOD

(71) Applicant: Hisashi Sugawara, Tokyo (JP)

(72) Inventor: Hisashi Sugawara, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 22 days.

(21) Appl. No.: 14/434,042

(22) PCT Filed: Jan. 25, 2013

(86) PCT No.: PCT/JP2013/051613

§ 371 (c)(1),
(2) Date: Apr. 7, 2015

(87) PCT Pub. No.: WO2014/115309

PCT Pub. Date: Jul. 31, 2014

(65) Prior Publication Data

US 2015/0262483 A1 Sep. 17, 2015

(51) Int. Cl.

| | |
|---|---|
| ***G08G 1/096*** | (2006.01) |
| ***G08G 1/0962*** | (2006.01) |
| ***G08G 1/0967*** | (2006.01) |

(52) U.S. Cl.

CPC ..... *G08G 1/096* (2013.01); *G08G 1/0962* (2013.01); *G08G 1/096716* (2013.01); *G08G 1/096758* (2013.01); *G08G 1/096783* (2013.01)

(58) Field of Classification Search

CPC ..... G08G 1/096; G08G 1/0962; G08G 1/096783; G08G 1/096725; G08G 1/09
USPC ..... 340/907, 929, 916, 933; 455/344–345
See application file for complete search history.

(56) References Cited

U.S. PATENT DOCUMENTS

| | | | | |
|---|---|---|---|---|
| 2006/0009188 | A1* | 1/2006 | Kubota | G08G 1/096725 455/344 |
| 2008/0253615 | A1 | 10/2008 | Kubota et al. | |
| 2011/0001634 | A1 | 1/2011 | Yokoyama et al. | |
| 2011/0260886 | A1* | 10/2011 | Nagura | G08G 1/081 340/905 |
| 2012/0136560 | A1 | 5/2012 | Muramatsu et al. | |

FOREIGN PATENT DOCUMENTS

| | | | |
|---|---|---|---|
| JP | 2006-048624 | A | 2/2006 |
| JP | 2009-217729 | A | 9/2009 |
| JP | 2010-054484 | A | 3/2010 |
| JP | 2010-230561 | A | 10/2010 |
| JP | 2010-238037 | A | 10/2010 |
| JP | 2010-267052 | A | 11/2010 |
| JP | 2012-003543 | A | 1/2012 |
| JP | 2012-118754 | A | 6/2012 |

* cited by examiner

*Primary Examiner* — Hung T Nguyen
(74) *Attorney, Agent, or Firm* — Birch, Stewart, Kolasch & Birch, LLP

(57) ABSTRACT

A movement assistance device includes a provided information acquirer that acquires, traffic signal cycle data in which traffic signal data comprised of identification information of a traffic light, which is stored in an SNS server, and an image capture date and time and a lighting duration time of the traffic light is organized for each light color pattern of the traffic light, and that specifies, from the identification information of the traffic light of the traffic signal cycle data, a traffic light which a moving object will pass, and calculates a remaining lighting time which will elapse until the lighting of each light color of the specified traffic light is ended from both the time difference between the image capture date and time of each light color of the traffic signal cycle data and the current time, and the lighting duration time of the traffic signal cycle data.

14 Claims, 14 Drawing Sheets

| Traffic Light ID | Image Capture Date and Time | Light Color (Change) |
|---|---|---|
| 12345 | 2012/08/23 07:59:58 | Yellow |
| 12345 | 2012/08/23 08:00:00 | Yellow→Red |
| 12345 | 2012/08/23 08:00:48 | Red→Green |

| Traffic Light ID | Image Capture Date and Time (Start Date and Time) | Light Color | Lighting Duration Time[sec] |
|---|---|---|---|
| 12345 | 2012/08/23 07:59:56 | Yellow | 4 |
| 12345 | 2012/08/23 08:00:00 | Red | 48 |
| 12345 | 2012/08/23 08:00:48 | Green | 48 |

| Traffic Light ID | Image Capture Date and Time | Light Color (Change) |
|---|---|---|
| 12345 | 2012/08/23 08:02:29 | Red→Green |

MOVEMENT ASSISTANCE DEVICE AND MOVEMENT ASSISTANCE METHOD

FIELD OF THE INVENTION

The present invention relates to a movement assistance device for and a movement assistance method of providing assistance information, such as traffic signal information, for a moving object or a passenger in the moving object.

BACKGROUND OF THE INVENTION

In recent years, an interest in global environment problems has increased and an improvement in the energy efficiency has been required. As a measure against global environment problems, there exists a green wave driving assistance system that assists an optimal method of making a user drive through continuous signalized intersections on the basis of traffic light information acquired via road-to-vehicle communications, thereby preventing useless acceleration and deceleration of the vehicle and providing an improvement in the fuel efficiency.

A problem with a conventional system using road-to-vehicle communications is that because there is a necessity to place a huge number of roadside units each of which transmits traffic light information to vehicles in the surroundings of intersections, it is difficult to put this system to practical use.

As a technique for solving this problem, for example, patent reference 1 discloses a navigation device that generates a traffic signal database via a vehicle-mounted unit or a server by capturing the light color of a traffic light using a camera mounted in a vehicle and analyzing image data, and provides traffic signal guidance information.

Further, patent reference 2 discloses a vehicle-mounted device that guides a remaining time which will elapse until the light color of the traffic light changes by acquiring the lighting time of a specific light color of the traffic light by analyzing data about a video of an area ahead of the vehicle without going through infrastructure equipment.

In addition, patent reference 3 discloses a traffic signal predicting device that forms a traffic light information database by using traffic light information acquired via road-to-vehicle communications, and predicts the time required for the light color of a traffic light to change.

RELATED ART DOCUMENT

Patent reference

Patent reference 1: Japanese Unexamined Patent Application Publication No. 2006-048624

Patent reference 2: Japanese Unexamined Patent Application Publication No. 2010-230561

Patent reference 3: Japanese Unexamined Patent Application Publication No. 2010-238037

SUMMARY OF THE INVENTION

Problems to be Solved by the Invention

A problem with the technique disclosed by above-mentioned patent reference 1 is, however, that because traffic signal prediction information is generated by storing traffic light information and finding out a correlation, it takes much time to acquire the correlation, or the correlation cannot be found out easily in the case of a traffic light of adaptive control type. Further, a problem with the technique disclosed by above-mentioned patent reference 2 is that because it is necessary to repeatedly acquire the display time of a specific color traffic signal, it takes much time to acquire each display time in the whole of a traffic signal cycle.

In addition, a problem with the technique disclosed by above-mentioned patent reference 3 is that while for a traffic light at an intersection where roadside units are installed, it is possible to predict a switching of the traffic signal on the basis of traffic light information acquired, the installation of roadside units costs a great deal and effects including driving assistance using traffic light information cannot be enjoyed until the infrastructure is disposed. A further problem is that in the case of a traffic light of adaptive control type which is placed in an urban area, because traffic light information is changed from moment to moment according to traffic conditions, there is a possibility that when only static traffic light information acquired when the vehicle passes an area in the vicinity of roadside units is referred to, the traffic light information has been changed.

On the other hand, in recent years, an inclination to adopt bidirectional communications and a large majority of communications has been provided, a post service for providing not only transmission of e-mails, but also, in, for example, the Internet environment, posting of a content, such as a blog, a chat, a bulletin board, an SNS (social networking service), or Twitter (registered trademark), has recently started becoming widespread. There is a demand that when getting on a vehicle, the user of a mobile device desires to succeedingly use the post service which the user has been using via the mobile device in the vehicle.

The present invention is made to solve the above-mentioned problems and fill the user's need, and it is therefore an object of the present invention to provide a movement assistance device and a movement assistance system that implement movement assistance by using traffic signal information acquired using a post service provided by an SNS site on the above-mentioned network.

Means for Solving the Problem

In accordance with the present invention, there is provided a movement assistance device including: a provided information acquirer that acquires, via an information communicator, traffic signal cycle data in which traffic signal data comprised of identification information of a traffic light, which is stored in an SNS server, and an image capture date and time and a lighting duration time of the traffic light is organized for each light color pattern of the above-mentioned traffic light, and that specifies, from the identification information of the traffic light of the traffic signal cycle data, a traffic light which a moving object will pass, and calculates a remaining lighting time which is a remaining time which will elapse until lighting of each light color of the specified traffic light is ended from both a time difference between an image capture date and time of each light color of the traffic signal cycle data and a current time, and the lighting duration time of the traffic signal cycle data, and an information outputter that provides the remaining lighting time calculated by the provided information acquirer.

Advantages of the Invention

According to the present invention, movement assistance information which is generated by using the newest traffic signal data updated in real time by using a post service on a network can be provided.

EMBODIMENTS OF THE INVENTION

Hereafter, in order to explain this invention in greater detail, the preferred embodiments of the present invention will be described with reference to the accompanying drawings.

Embodiment 1

Figure 1:
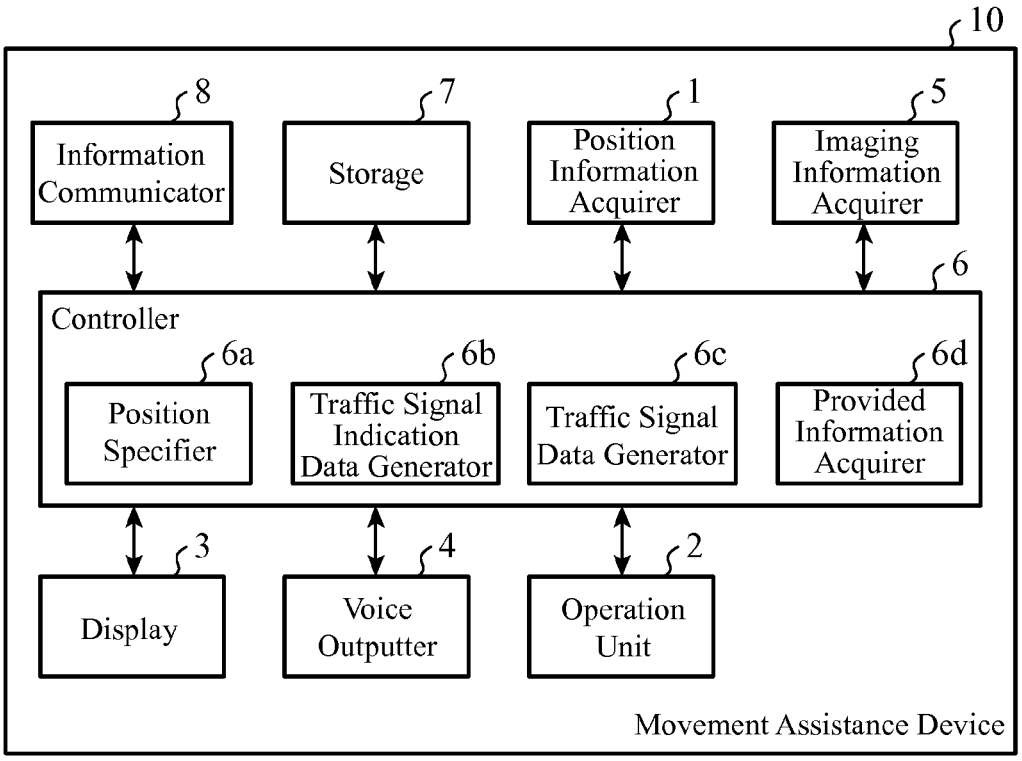
FIG. 1 is a block diagram showing the configuration of a movement assistance device in accordance with Embodiment 1.

FIG. 1 is a block diagram showing the configuration of a movement assistance device in accordance with Embodiment 1 of the present invention.

The movement assistance device 10 is comprised of a position information acquirer 1, an operation unit 2, a display (information outputter) 3, a voice outputter (information outputter) 4, an imaging information acquirer 5, a controller 6, a storage 7, and an information communicator 8. It is assumed that the movement assistance device 10 is mounted in or carried by a moving object. Further, it is assumed that the moving object is, for example, either a vehicle, such as a car or a bicycle, which moves as a result of being operated by a human being, or a pedestrian.

Further, as the movement assistance device 10, for example, there can be provided a portable device, such as a mobile phone owned by a person, a car navigation device mounted in a vehicle, a cycle computer mounted in a bicycle, or the like. It is assumed that the movement assistance device can be incorporated or mounted in such existing equipment as above, or can be used as a different body. Equipment as mentioned above is a product in which a GPS reception IC is already incorporated, and can be incorporated at a relatively low cost and with ease.

The movement assistance device 10 provides, as movement assistance information, the remaining time of the light color of each of traffic lights arranged on the road along which the moving object is travelling. Hereafter, each component of the movement assistance device 10 will be explained in detail.

It is preferable that the position information acquirer 1 is comprised of, for example, a GPS (Global Positioning System) unit that can recognize three-dimensional position information by receiving signals from satellites turning around the Earth. It is possible to acquire not only the position information but also the time information outputted by the satellites by using GPS. Further, the traveling direction and the speed can be calculated from a temporal change of the position. It is assumed that the direction information and the speed information are the ones which can be acquired by the position information acquirer 1 by default, or are calculated by the controller 6.

The operation unit 2 is comprised of mechanical key switches disposed in a peripheral portion of the display 3, a touch panel constructed integrally with the display 3, or the like, and functions as a user interface which can be operated by the user. The display 3 is comprised of, for example, a liquid crystal display monitor, and outputs video information on the basis of an input signal from the controller 6. The voice outputter 4 is configured to include a speaker and an amplifier, and outputs various guiding voices on the basis of an input signal from the controller 6.

The imaging information acquirer 5 is comprised of, for example, an image sensor, such as a camera, and captures an image of a traffic light located ahead of the moving object. Because the movement assistance device 10 is placed or carried by at a position which the imaging information acquirer 5 can capture an image of an area ahead of the moving object, the imaging information acquirer 5 can generate video data about the area ahead of the moving object.

By executing various programs stored in the storage 7, the controller 6 performs centralized control of the whole of the movement assistance device 10 and implements various functions. Concretely, the controller 6 is comprised of a position specifier 6*a*, a traffic signal indication data generator 6*b*, a traffic signal data generator 6*c*, and a provided information acquirer 6*d*.

On the basis of an input signal from the position information acquirer 1, the position specifier 6*a* specifies the current position and the traveling direction of the moving object and also specifies the position of a traffic light included in the video data. The traffic signal indication data generator 6*b* generates traffic signal indication data showing the current light color of the traffic light which exists at the current position of the moving object and in the traveling direction of the moving object by using the result specified by the position specifier 6*a*. The traffic signal data generator 6*c* generates traffic signal duration data (traffic signal data) showing the duration that each light color of the traffic light is displayed by using the traffic signal indication data generated by the traffic signal indication data generator 6*b*. The provided information acquirer 6*d* acquires traffic signal cycle data which is posted to a posting site, such as an SNS (social networking service) site on a network, and which shows traffic signal data about all the light colors which construct the light color pattern of the traffic light (e.g., a pattern of red, green, and yellow), and calculates the remaining lighting time which is the remaining time which will elapse until the lighting of the light color of the traffic light which the moving object will pass is ended.

The storage 7 stores information to which the controller 6 refers when performing each of various determinations. For example, the storage stores road map data showing a connection relation between roads, the installation positions of traffic lights, and the lighting directions (bearings) of the traffic lights. It is further assumed that the storage also stores parameter information which is needed when the controller 6 performs each of the various determinations, and the parameter information is acquired from the road map data or the like as needed and the parameter information is stored in advance in the storage. Further, the storage temporarily records and manages the traffic signal indication data generated by the traffic signal indication data generator 6*b*, and so on.

Further, the storage 7 can be configured in such a way that information about a traffic light ID is stored while being associated with the data about each traffic light stored in the storage 7. Because a specific ID is assigned to each traffic light and this traffic light ID is used also in the road map data, in the road map data, the traffic light ID of the traffic light installed at each intersection (node) is registered in the node data about the corresponding intersection. Concretely, each traffic light ID is registered in the node data while being associated with information about the approach routes (links) to the intersection where the corresponding traffic light displays the traffic signal. The node data shows the position of the corresponding intersection and a connection relation with the roads (links), like node data which a well-known car navigation device has.

Each of traffic lights installed at intersections can be a one which operates in such a way as to change its traffic signal at the same time as the traffic light installed in the opposite lane, or can be a one which performs an asynchronous operation like staggered traffic lights. Further, because there is a case in which separate traffic lights for pedestrians and vehicles or the like are installed, the load on the storage 7 increases when either information showing synchronous or asynchronous or information showing whether or not a sub area with other traffic lights is formed is recorded for each of all the traffic lights. Therefore, it is preferable to dispose a signal ID for each bearing of each identical traffic light, and handle traffic light information.

The information communicator 8 posts the traffic signal duration data (traffic signal data) generated by the traffic signal data generator 6*c* of the controller 6 to a predetermined posting site on the network. This network can be, for example, a one which is connected to a server which a carmaker independently prepares, such as a telematics which is a telecommunications service intended for cars, or communications with a WEB server by using a channel for a third generation mobile phone (3G) such as a smart phone which is a multifunctional mobile phone. Further, as the above-mentioned posting site, for example, there can be provided a website in a service (SNS: Social Networking Service) which constructs a social network on the Internet, or the like.

Next, the operation of the movement assistance device 10 in accordance with Embodiment 1 will be explained.

The operation of the movement assistance device 10 will be explained by dividing the operation into a process of recording traffic signal indication data, a process of posting traffic signal duration data, and a process of providing traffic light information.

Figure 2:
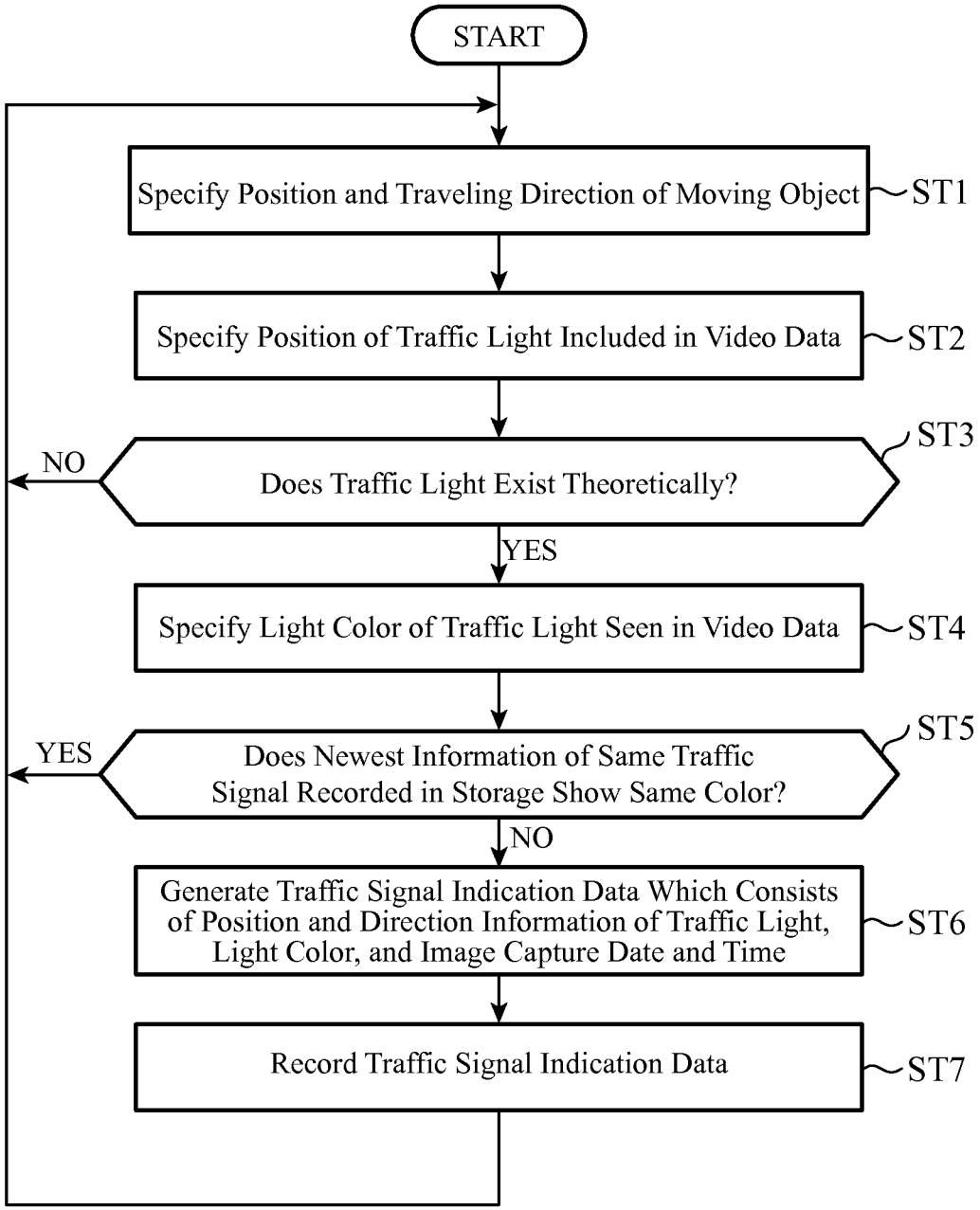
FIG. 2 is a flow chart showing a traffic signal indication data recording process performed by the movement assistance device in accordance with Embodiment 1.

First, the process of recording traffic signal indication data will be explained with reference to a flowchart of FIG. 2. FIG. 2 is a flow chart showing the traffic signal indication data recording process performed by the movement assistance device in accordance with Embodiment 1 of the present invention. The traffic signal indication data recording process is a one which the position specifier 6*a* and the traffic signal indication data generator 6*b* of the controller 6 repeatedly perform at fixed time intervals, and includes a step of analyzing the video data outputted from the imaging information acquirer 5, a step of specifying the light color of each traffic light seen in the video data, and a step of recording a result of this specification in the storage 7.

First, the position specifier 6*a* of the controller 6 specifies the position and the traveling direction of the moving object on the basis of the input signal from the position information acquirer 1 (step ST1). Next, on the basis of a result of the specification in step ST1, and the position information about traffic lights stored in the storage 7, the position specifier calculates the distance between a traffic light included in the video data captured by the imaging information acquirer 5 and the moving object and specifies the position coordinates of the above-mentioned traffic light (step ST2). In this case, it can be assumed that the relative distance between the traffic light and the moving object is recorded separately in the storage 7.

Although when a plurality of traffic lights are detected in step ST2, it is also possible to perform a process which will be mentioned below on the plurality of traffic lights, a case in which the process is performed on the traffic light located the nearest to the moving object will be explained hereafter.

The traffic signal indication data generator 6*b* of the controller 6 refers to the position coordinates of the traffic light specified in step ST2, and determines whether the traffic light included in the video data theoretically exists at the current position of the moving object and in the traveling direction of the moving object (step ST3). When the traffic light does not exist theoretically (when NO in step ST3), the controller returns to the process of step ST1. In contrast, when the traffic light exists theoretically (when YES in step ST3), the traffic signal indication data generator 6*b* specifies the light color of the traffic light seen in the video data (step ST4). In the explanation of this Embodiment 1, it is assumed that the traffic signal indication data generator neglects arrow traffic signals and specifies which of green, yellow and red the light color of the traffic light is.

Next, the traffic signal indication data generator 6*b* determines whether or not the information associated with the traffic light specified in step ST2 and also associated with the light color of the traffic light specified in step ST4 is stored in the storage 7 (step ST5). In other words, the traffic signal indication data generator, in step ST5, determines whether the newest information about the same traffic light stored in the storage 7 shows the same color as the light color specified in step ST4. When the information is stored in the storage 7 (when YES in step ST5), the controller returns to the process of step ST1. In contrast, when the information is not stored in the storage 7 (when NO in step ST5), the traffic signal indication data generator 6*b* generates traffic signal indication data comprised of the position and bearing information of the traffic light seen in the video data, the information showing the light color of the traffic light specified in step ST4, and the information about the image capture date and time corresponding to the analyzed video data (still image frame) (step ST6). The controller records the traffic signal indication data generated in step ST6 in a traffic signal indication data history stored in the storage 7 (step ST7), and returns to the process of step ST1.

Figures 3, 4:
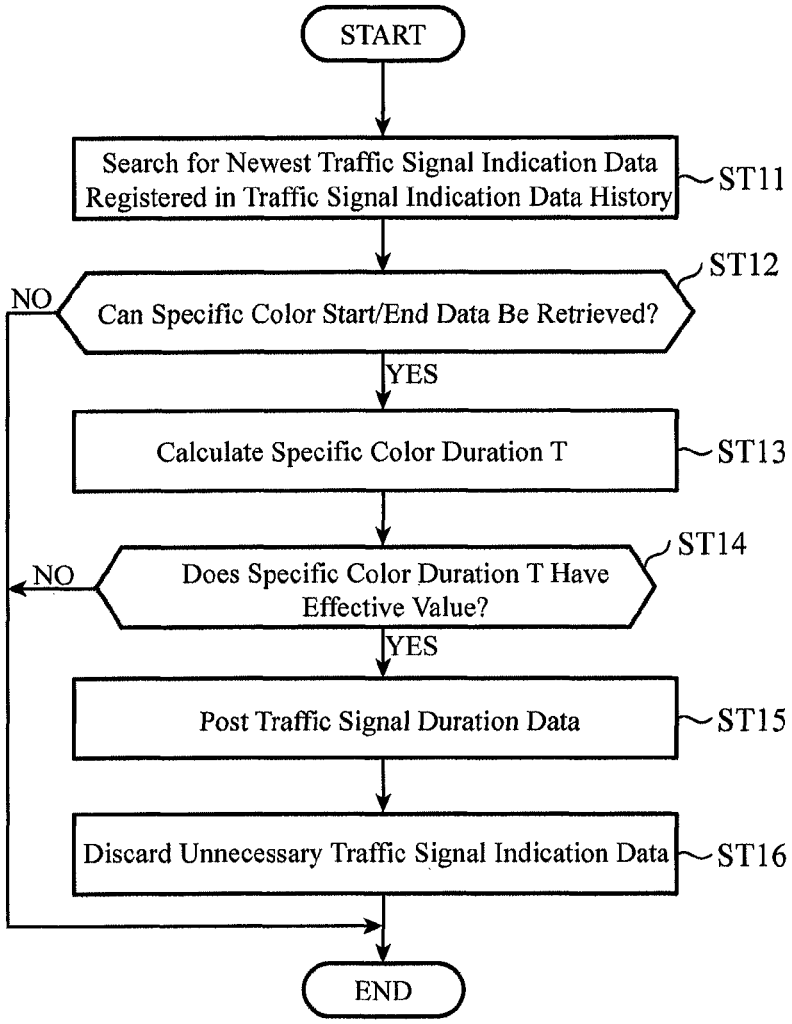
FIG. 3 is a diagram showing an example of a traffic signal indication data history generated by a controller of the movement assistance device in accordance with Embodiment 1.
FIG. 4 is a flow chart showing a traffic signal duration data posting process performed by the movement assistance device in accordance with Embodiment 1.

FIG. 3 is a diagram showing an example of the traffic signal indication data history stored in the storage of the movement assistance device in accordance with Embodiment 1 of the present invention. The traffic signal indication data history consists of entries each having a "traffic light ID", an "image capture date and time", and a "light color (change)." The "light color (change)" is shown to be "Yellow→Red" when, for example, the light color of the traffic light changes from yellow to red. Although the example of using traffic light IDs is shown in FIG. 3, any other information can be applied as long as this other information uniquely determines the position and direction information of a traffic light.

Next, the process of posting the traffic signal duration data which the traffic signal data generator 6*c* of the controller 6 performs in parallel with the above-mentioned process of recording the traffic signal indication data will be explained. This process of posting the traffic signal duration data can be performed at, for example, one of the following times.

(1) At the time when the light color of the traffic light changes (2) At the time when it becomes unable to detect the traffic light To be more specific, the time (1) is either of times when the light color of the traffic light changes from green to yellow, from yellow to red, and from red to green, and the traffic signal indication data associated with the same traffic light exists in step ST5 of the flow chart of FIG. 2, but the light color of the traffic signal indication data having the newest image capture date and time is not the same. Further, the time (2) is a one when the imaging information acquirer 5 becomes unable to acquire the light color of the traffic light, and the traffic signal indication data associated with the same traffic light does not exist in step ST5 of the flow chart of FIG. 2. The traffic signal data generator 6*c* of the controller 6*t* refers to the traffic signal indication data history, and sets the traffic light for which the traffic signal indication data exists to be a target for the posting process.

The process of posting the traffic signal duration data will be explained with reference to a flow chart of FIG. 4. FIG. 4 is a flow chart showing the traffic signal duration data posting process performed by the movement assistance device in accordance with Embodiment 1 of the present invention. In the traffic signal duration data posting process, the traffic signal data generator 6*c* of the controller 6 calculates the lighting duration time of each light color of the traffic light seen in the video data on the basis of the traffic signal indication data history stored in the storage 7. More specifically, the traffic signal data generator calculates the time which elapses after the start of the lighting of each of the green light, the yellow light, and the red light until the lighting is ended.

In this case, because traffic lights having arrow traffic signals include a traffic light having a pattern of changing from the red light to the yellow light, and then to an arrow traffic signal (red) when irregularly changing to the arrow, the yellow light can be handled in the same way that the red light is handled. Hereafter, a case of calculating the display times of only the red light and the green light will be explained.

First, the traffic signal data generator 6*c* refers to the traffic signal indication data group registered in the traffic signal indication data history in reverse chronological order starting from the data having the newest image capture date and time, and searches for the traffic signal indication data showing that the light color of the traffic light, which is the processing target, changed at a past time the nearest to the current time (step ST11). In addition, the traffic signal data generator 6*c* refers to the traffic signal indication data searched for in step ST11, and determines whether or not to be able to retrieve, from the traffic signal indication data group which is the above-mentioned processing target, traffic signal indication data (referred to as specific color end data from here on) which has been provided immediately after the light color associated with the traffic light which is the processing target changed to the light color shown by the newest traffic signal indication data, and traffic signal indication data (referred to as specific color start data from here on) which is adjacent in time to this specific color end data in reverse chronological order and which has been provided immediately after the light color changed (step ST12). In the example shown in FIG. 3, when the specific color is "Red", the data in which the light color is "Red→Green" and the image capture date and time is "08:00:48" can be retrieved as the specific color end data and the data in which the light color is "Yellow→Red" and the image capture date and time is "08:00:00" can be retrieved as the specific color start data.

When no satisfying traffic signal indication data cannot be retrieved (when NO in step ST12), the controller ends the processing. In contrast, when the satisfying traffic signal indication data can be retrieved (when YES in step ST12), the traffic signal data generator 6*c* assumes that the image capture date and time shown by the specific color end data is a specific color display end date and time of the traffic light and the image capture date and time shown by the specific color start data is a specific color display start date and time of the traffic light, and calculates a specific color duration T from the traffic light ID of this traffic light, i.e., the ID of the processing target, the specific color display start date and time, and the specific color display end date and time (step ST13). In the example shown in FIG. 3, the specific color duration T is calculated to be "48 [sec]" with the light color being "red."

Next, the traffic signal data generator 6*c* determines whether the specific color duration T calculated in step ST13 has an effective value (step ST14). The determination of whether or not the specific color duration is effective is performed by determining whether the specific color duration T falls within a range from an upper limit T_max to a lower limit T_min, these limits being stored in the recording unit 7. It is assumed that the upper limit and the lower limit are set for each light color which constructs the traffic signal cycle. Further, as the above-mentioned upper and lower limits, determined display times are typically set as parameters.

When the specific color duration T does not have an effective value (when NO in step ST14), the controller ends the processing. In contrast, when the specific color duration T has an effective value (when YES in step ST14), the traffic signal data generator 6*c* generates traffic signal duration data comprised of the traffic light ID, the light color and the specific color duration T, which are determined in step ST13, and the image capture date and time (the start date and time or the end date and time), and posts the traffic signal duration data to the SNS site on the network via the information communicator 8 (step ST15). The traffic signal data generator can perform the posting of the traffic signal duration data automatically at the time of generating the traffic signal duration data. As an alternative, the traffic signal data generator can be configured to temporarily record the traffic signal duration data in the storage 7, and, after that, cause the moving object or a passenger in the moving object to select whether or not to post the traffic signal duration data via the operation unit 2.

After that, the traffic signal data generator 6*c* discards unnecessary traffic signal indication data among the information used in the above-mentioned processes of steps ST11 to ST15 (step ST16), and ends the processing. In step ST16, the traffic signal data generator discards all pieces of information associated with the traffic signal duration data posted in step ST15. By deleting the unnecessary data and regularly recording only information about each traffic light in the storage 7, only a low amount of storage area is used, and therefore the movement assistance device can be implemented at a low cost.

It is assumed that the SNS site on the network has a storage that manages the traffic signal duration data posted thereto by the movement assistance device 10 while providing a link on the basis of either the traffic signal ID or the position coordinates and bearing of the traffic light. Further, at the time when the traffic signal duration data posted by each moving object are gathered for all the light colors including red, green and yellow which construct the light color pattern of the traffic light, the traffic signal duration data, as well as the position information about the traffic light, are reflected in an SNS server. As mentioned above, by assuming that the yellow light is treated as like the red light, and configuring the traffic signal cycle only from the red light and the green light, a trouble can be prevented from occurring in a complicated intersection, or a reflection in the SNS server can be performed promptly. It is further assumed that the traffic signal duration data of each light color is regularly updated to one having a new image capture date and time, and is stored and reflected. As a result, even in the case of a traffic light on which adaptive control or the like is performed, the movement assistance device can provide high-accuracy traffic signal cycle data at a relatively opportune time.

Figure 5:
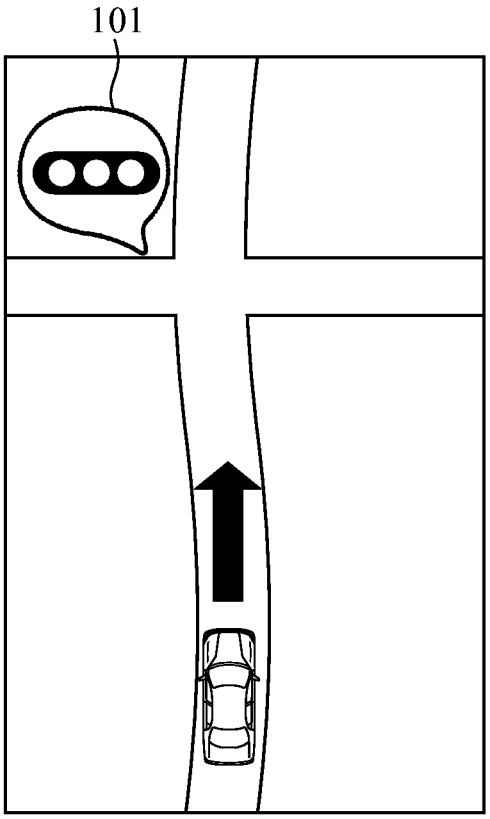
FIG. 5 is a diagram showing an example of display contents on a display at the time when the movement assistance device in accordance with Embodiment 1 acquires traffic signal cycle data.

Next, the process of providing the traffic light information which the provided information acquirer 6*d* of the controller 6 performs in parallel with the above-mentioned process of recording the traffic signal indication data and the above-mentioned process of posting the traffic signal duration data will be explained. In this traffic light information providing process, for example, the traffic light information can be automatically provided at the time when the traffic light information is reflected in the SNS server. As an alternative, the provided information acquirer can be configured to notify the traffic light information to either the moving object or a passenger in the moving object by displaying an icon 101 or the like which is popped up on the display 3 shown in FIG. 5, and, after that, enable the moving object or the passenger to select whether or not to provide the traffic light information via the operation unit 2. In the example of FIG. 5, it is determined that the traffic light information can be provided when the icon 101 is clicked.

The traffic light information providing process will be explained with reference to a flow chart of FIG. 6.

Figures 6, 7:
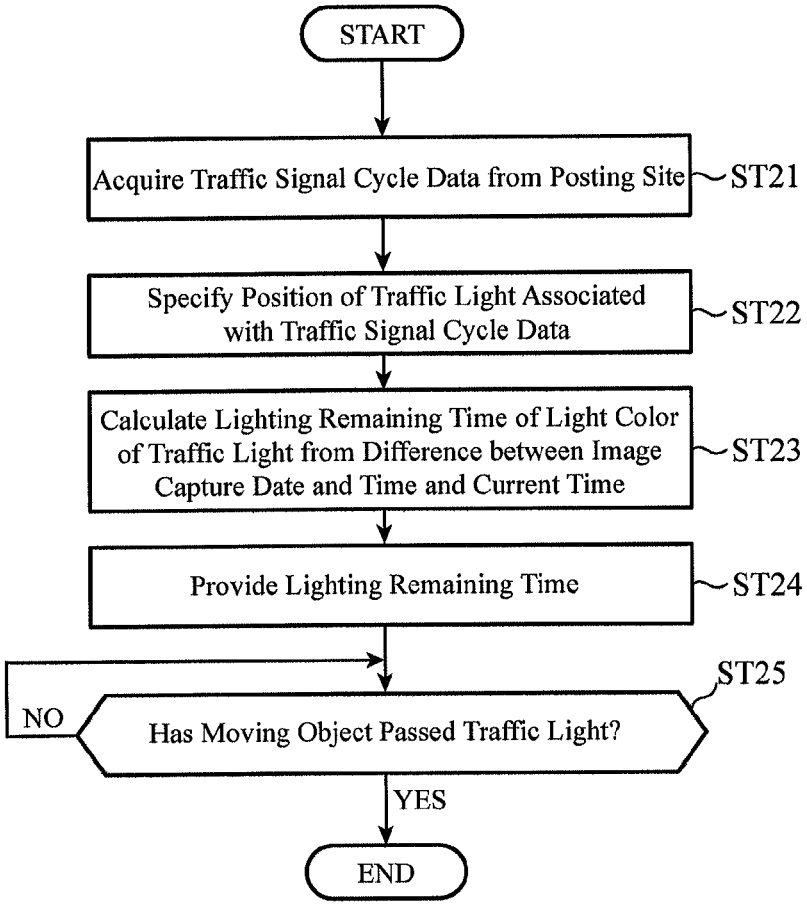
FIG. 6 is a flow chart showing a traffic signal data providing process performed by the movement assistance device in accordance with Embodiment 1.
FIG. 7 is a diagram showing an example of the traffic signal cycle data which an information acquiring unit of the movement assistance device in accordance with Embodiment 1 acquires.

FIG. 6 is a flow chart showing the traffic light information providing process performed by the movement assistance device in accordance with Embodiment 1 of the present invention. Hereafter, the traffic signal duration data group regarding all the light colors which construct the light color pattern of the traffic light is referred to as traffic signal cycle data.

First, the provided information acquirer 6*d* of the controller 6 acquires the traffic signal cycle data from the posting site via the information communicator 8 (step ST21). The acquired traffic signal cycle data consists of, for example, a "traffic light ID", an "image capture date and time (a start date and time)", a "light color", and a "lighting duration time [sec]", as shown in FIG. 7. The provided information acquirer specifies the position of the traffic light on a map stored in the storage 7 from either the traffic light ID of the traffic signal cycle data acquired in step ST21 or the position and bearing of the traffic light (step ST22). The provided information acquirer can be configured to, when the position of the traffic light is not the one of the traffic light associated with the intersection which the moving object is due to pass immediately afterward, not acquire the traffic signal cycle data, for example.

Next, the provided information acquirer 6*d* establishes the synchronization of the traffic light information from the difference between the image capture date and time of the traffic signal cycle data and the current time, calculates the remaining lighting time which is the remaining time which will elapse until the lighting of the current light color of the traffic light is ended from the lighting duration time of the traffic signal cycle data (step ST23), and provides the calculated remaining lighting time for the moving object or a passenger in the moving object via the display 3 and the voice outputter 4 (step ST24). The provided information acquirer can be configured to, in the calculation of step ST23, acquire the remaining lighting times of the other light colors, in addition to the remaining lighting time of the current light color of the traffic light, and, in step ST24, provide the remaining lighting times of all the light colors of the traffic light.

After that, the provided information acquirer 6*d* determines whether the moving object has passed the traffic light on the basis of both the position information of the moving object inputted from the position information acquirer 1 and the map information stored in the storage 7 (step ST25). When the moving object has not passed the traffic light (when NO in step ST25), the provided information acquirer continues the determining process of step ST25. In contrast, when the moving object has passed the traffic light (when YES in step ST25), the provided information acquirer ends the processing.

Explaining the process shown in the flow chart of FIG. 6 with reference to the concrete example of FIG. 7, because it can be determined that 145 seconds have elapsed from the difference with the newest image capture date and time "2012/08/23 08:00:48" shown in FIG. 7 when the current time is "2012/08/23 08:03:13", it can be determined that the traffic light is in a state in which 45 seconds have elapsed after the lighting start time of the green light. More specifically, the movement assistance device can provide information showing that the remaining lighting time of the green light which is the current light color of the traffic light is 3 seconds.

Figure 8:
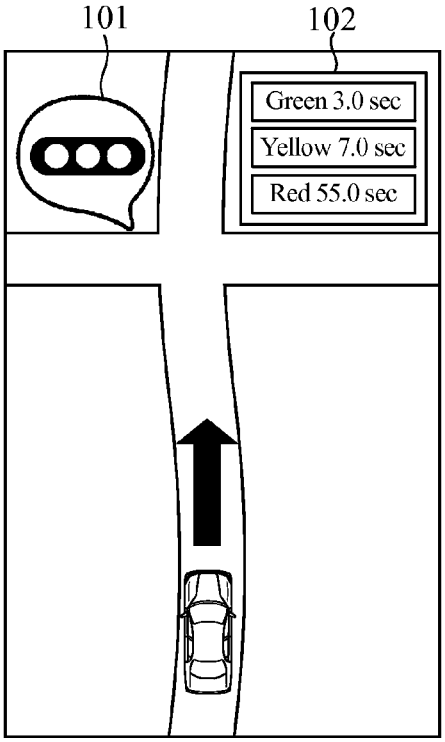
FIG. 8 is a diagram showing a display example at the time of traffic signal synchronization in the movement assistance device in accordance with Embodiment 1.

Further, although the process of providing the remaining lighting time for the moving object or a passenger in the moving object in above-mentioned step ST24 is shown, an example of a displaying method in the case of displaying the remaining lighting time on the display 3 is shown in FIG. 8. For example, when it is assumed that the lighting pattern of the traffic light consists of green, yellow, and red, the remaining lighting time until each light color disappears in the traffic light shown by the icon 101 is displayed in a display area 102 as shown in FIG. 8. Further, the displayed remaining lighting time is decremented from moment to moment with the passage of time, and is provided. When the light color of the traffic signal changes, the display positions of the light colors in the display area 102 of FIG. 8 are changed in such a way that they are aligned in display order after the change.

As mentioned above, the movement assistance device according to this Embodiment 1 is configured to include the provided information acquirer 6*d* that acquires traffic signal cycle data which is configured on the basis of traffic signal duration data posted to the SNS site on the network, and that acquires and provides the remaining lighting time of the light color of the traffic light which the moving object will pass, the movement assistance device can offer movement assistance which provides the remaining time of the lighting of the light color of the traffic light which the moving object will pass from this time on by using the newest information which is configured using the posted traffic signal duration data.

Further, the movement assistance device according to this Embodiment 1 is configured to include the position specifier 6*a* that specifies the position of a traffic light included in the video data acquired by the imaging information acquirer 5, the traffic signal indication data generator 6*b* that acquires the current light color of the traffic light, the traffic signal data generator 6*c* that generates traffic signal duration data comprised of the identification information of the traffic light, the light color of the traffic light, the specific color duration T, and the image capture date and time (the start date and time or the end date and time), and the information communicator 8 that transmits the traffic signal duration data, the movement assistance device can post the traffic signal data group of all the light colors which construct the light color pattern of the traffic light to the SNS site, and can achieve timely provision of movement assistance information.

Further, because the provided information acquirer 6*d* according to this Embodiment 1 is configured to acquire the remaining lighting time of the light color of the traffic light by using the traffic signal cycle data generated on the basis of the timely information posted to the SNS site, the movement assistance device can provide relatively-high-accuracy movement assistance also in the case of a traffic light of adaptive control type which changes from moment to moment. Further, by using the duration of a specific traffic signal acquired from a plurality of moving objects, the movement assistance device can shorten the time required to be able to use the traffic signal cycle data for movement assistance.

Although the configuration which posts all the traffic signal duration data that the traffic signal data generator 6*c* generates is shown in above-mentioned Embodiment 1, the movement assistance device can be configured to, when traffic signal cycle data can be acquired by the SNS server, post the traffic signal duration data only when the traffic signal duration data differs from the traffic signal duration data associated with the same light color. As a result, unnecessary posts can be reduced, and the load on the SNS site and the SNS server can be reduced.

Embodiment 2

In this Embodiment 2, a configuration which uses data showing the time when the light color of a traffic light changes, instead of traffic signal duration data, will be shown. Concretely, a configuration which, when the traffic signal duration data of a certain light color cannot be acquired, posts data showing a time which will elapse until the light color of the traffic light changes, instead of the traffic signal duration data, and a configuration which performs interpolation by using the data showing the time when the light color of the traffic light changes and establishes the synchronization of traffic light information, and calculates a traffic signal remaining time are shown.

Figure 9:
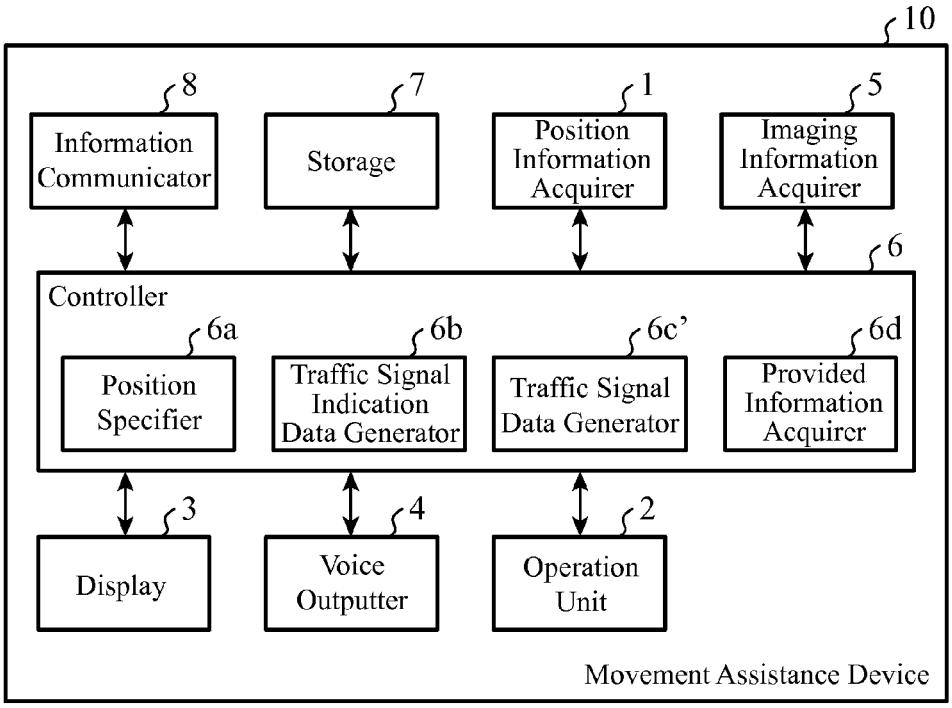
FIG. 9 is a block diagram showing the configuration of a movement assistance device in accordance with Embodiment 2.

FIG. 9 is a block diagram showing the configuration of a movement assistance device in accordance with Embodiment 2 of the present invention.

The movement assistance device 10 in accordance with Embodiment 2 includes a traffic signal data generator 6*c*' instead of the traffic signal data generator 6 of the movement assistance device 10 in accordance with Embodiment 1 shown in FIG. 1. Hereafter, the same components as those of the movement assistance device 10 in accordance with Embodiment 1 or like components are denoted by the same reference numerals as those used in Embodiment 1, and the explanation of the components will be omitted or simplified.

The traffic signal data generator 6*c*' generates data (traffic signal time data) about a traffic signal switching time which will elapse after the lighting of a light color (first light color) of a traffic light is ended before the lighting of a different light color (second light color) is started by using traffic signal indication data acquired by a traffic signal indication data generator 6*b*. The traffic signal switching time data generated by the traffic signal data generator 6*c*' is recorded in a storage 7.

Next, the operation of the movement assistance device in accordance with Embodiment 2 will be explained.

First, a process of posting the traffic signal switching time data which the traffic signal data generator 6*c*' of a controller 6 performs in parallel with a traffic signal indication data recording process will be explained. The time when this traffic signal switching time data posting process is performed is the same as either of the times (1) and (2) shown in Embodiment 1.

Figure 10:
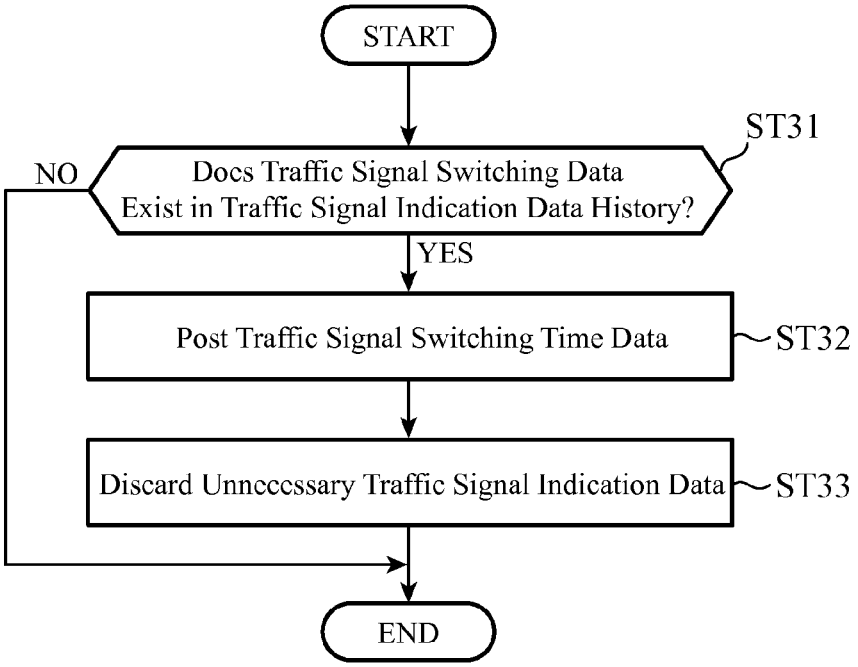
FIG. 10 is a flow chart showing a traffic signal switching time data posting process performed by the movement assistance device in accordance with Embodiment 2.

FIG. 10 is a flow chart showing the traffic signal switching time data posting process performed by the movement assistance device in accordance with Embodiment 2 of the present invention.

The traffic signal data generator 6*c*' of the controller 6 determines whether information showing a switching of a traffic signal exists in a traffic signal indication data history stored in the storage 7 (step ST31). In this case, because traffic lights having arrow traffic signals include a traffic light having a pattern of changing from the red light to the yellow light, and then to an arrow traffic signal (red) when irregularly changing to the arrow, as mentioned above, the yellow light can be handled in the same way that the red light is handled, and only switching information about only switchings from the red light to the green light and from the green light to the yellow light can be determined as a retrieval target.

For example, in the example of the traffic signal indication data history shown in FIG. 3 of Embodiment 1, data in which the light color is "Red→Green" and the image capture date and time is "08:00:48" and data in which the light color is "Yellow→Red" and the image capture date and time is "08:00:00" are determined to be traffic signal switching time data.

When no information showing a switching of a traffic signal exists (when NO in step ST31), the movement assistance device ends the processing. In contrast, when information showing a switching of a traffic signal exists (when YES in step ST31), the traffic signal data generator 6*c*' retrieves the corresponding traffic signal switching time data from the storage 7, and posts the traffic signal switching time data to an SNS site via an information communicator 8 (step ST32). The traffic signal data generator can perform the posting of step ST32 automatically at the time of retrieving the traffic signal switching time data. As an alternative, the traffic signal data generator can be configured to temporarily store the traffic signal switching time data in the storage 7, and, after that, cause the moving object to select whether or not to post the traffic signal switching time data via an operation unit 2.

After that, the traffic signal data generator 6*c*' discards unnecessary traffic signal indication data among the information used in the above-mentioned processes of steps ST31 and ST32 (step ST33), and ends the processing. By deleting the unnecessary data and regularly recording only information about each traffic light in the storage 7, only a low amount of storage area is used, and therefore the movement assistance device can be implemented at a low cost.

It is assumed that the SNS site on a network has a storage that manages the traffic signal switching time data posted thereto by the movement assistance device 10 while providing a link on the basis of either the traffic signal ID or the position coordinates and bearing of the traffic light. Further, the effective time of each light color is calculated on the basis of the traffic signal switching time data posted from each moving object. It is assumed that, concretely, the processes of steps ST12 to ST14 shown in FIG. 4 of Embodiment 1 are performed by the SNS site, and the effective traffic signal duration data of each light color is acquired. After that, at the time when the traffic signal duration data of the light colors including red, green and yellow which construct the light color pattern of the traffic light are gathered, the traffic signal duration data, as well as the position information about the traffic light, are reflected, as traffic signal cycle data, in the SNS server. As mentioned above, by assuming that the yellow light is treated as like the red light, and configuring the traffic signal cycle only from the red light and the green light, a trouble can be prevented from occurring in a complicated intersection, or a reflection in the SNS server can be performed promptly.

It is further assumed that the traffic signal duration data of each light color which constructs the lighting pattern of the traffic light is regularly updated to one having a new image capture date and time, and is stored and reflected. More specifically, it is assumed that the newest traffic signal switching time data is posted to the SNS site. As a result, even in the case of a traffic light on which adaptive control or the like is performed, the movement assistance device can provide high-accuracy traffic signal cycle data at a relatively opportune time.

Next, a traffic light information providing process which a provided information acquirer 6*d* performs in parallel with the above-mentioned traffic signal indication data recording process and the above-mentioned traffic signal switching time data posting process will be explained.

In this traffic light information providing process, the provided information acquirer can be configured to, when the difference between the image capture date and time of the traffic signal cycle data and the current time cannot be acquired, perform interpolation with the traffic signal switching time data stored in the storage 7 and establish the synchronization of the traffic light information, or establish the synchronization of the traffic light information only by using the traffic signal switching time data recorded in the storage 7.

Hereafter, the configuration which establishes the synchronization of the traffic light information only by using the traffic signal switching time data recorded in the storage 7 will be explained as an example.

Figures 11, 12:
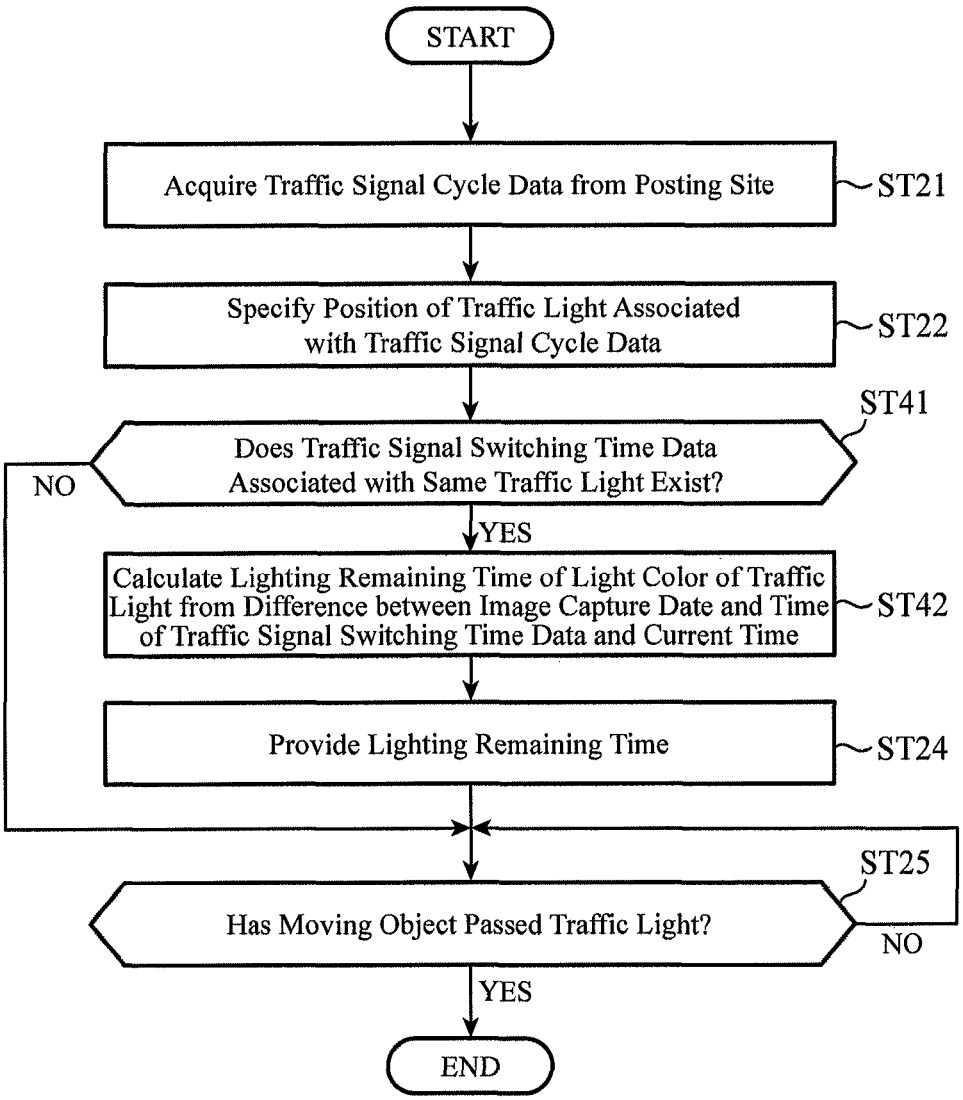
FIG. 11 is a flow chart showing a traffic signal data providing process performed by the movement assistance device in accordance with Embodiment 2.
FIG. 12 is a diagram showing an example of traffic signal indication data which a controller of the movement assistance device in accordance with Embodiment 2 generates.

FIG. 11 is a flow chart showing the traffic signal providing process performed by the movement assistance device in accordance with Embodiment 2 of the present invention. Hereafter, the same steps as those of the movement assistance device 10 in accordance with Embodiment 1 are denoted by the same reference characters as those used in FIG. 6, and the explanation of the steps will be omitted or simplified.

First, the provided information acquirer 6*d* acquires the traffic signal cycle data from a posting site via the information communicator 8 (step ST21). The traffic signal cycle data acquired is configured as shown in, for example, FIG. 7. The provided information acquirer 6*d* specifies the position of the traffic light on a map stored in the storage 7 from either the traffic light ID of the traffic signal cycle data acquired in step ST21 or the position and bearing of the traffic light (step ST22). The provided information acquirer can be configured to, when the position of the traffic light is not the one of the traffic light associated with the intersection which the moving object is due to pass immediately afterward, not acquire the traffic signal cycle data, for example.

Next, the provided information acquirer 6*d* refers to the traffic signal switching time data stored in the storage 7, and determines whether traffic signal switching time data associated with a traffic light which is the same as the traffic light specified in step ST22 exists (step ST41). Concretely, when traffic signal switching time data whose traffic light ID or position coordinates and bearing of the traffic light are the same as those of the traffic light, the provided information acquirer determines that the traffic signal switching time data can be used for synchronization. Further, the provided information acquirer can be configured to compare the image capture date and time of the acquired traffic signal cycle data with the image capture date and time of the traffic signal switching time data and use one of them nearer to the current time. An example of the traffic signal switching time data which is determined to exist is shown in FIG. 12. The traffic signal switching time data consists of a "traffic light ID", an "image capture date and time", and a "light color (change)."

When it is determined that the traffic signal switching time data associated with the same traffic light does not exist (when NO in step ST41), the controller ends the processing. In contrast, when it is determined that the traffic signal switching time data associated with the same traffic light exists (when YES in step ST41), the provided information acquirer 6*d* establishes the synchronization of the traffic light information from the difference between the image capture date and time of the traffic signal switching time data and the current time, and calculates the remaining lighting time of the current light color of the traffic light from the traffic signal switching time data (step ST42). The provided information acquirer 6*d* provides the remaining lighting time calculated in step ST42 for the moving object or a passenger in the moving object via a display 3 and a voice outputter 4 (step ST24). After that, the provided information acquirer 6*d* determines whether the moving object has passed the traffic light on the basis of the position information of the moving object inputted from a position information acquirer 1 and the map information stored in the storage 7 (step ST25). When the moving object has not passed the traffic light (when NO in step ST25), the provided information acquirer continues the determining process of step ST25. In contrast, when the moving object has passed the traffic light (when YES in step ST25), the provided information acquirer ends the processing.

Explaining the process shown in the flow chart of FIG. 11 with reference to the concrete example of FIG. 12, because it can be determined that, when the current time is "2012/08/23 08:03:13", 44 seconds have elapsed from the difference with the image capture date and time "2012/08/23 08:02:29" of the traffic signal switching time data shown in FIG. 12 (when plural traffic signal switching time data exist, the newest time and date). More specifically, the movement assistance device can provide information showing that the remaining lighting time of the green light which is the current light color of the traffic light is 4 seconds.

Because there is a high possibility that the period of each light color, and so on vary in a traffic light of adaptive control type when the image capture date and time of the traffic signal cycle data acquired from the SNS has passed a fixed time or more, the deviation from the actual light color of the traffic light can be reduced by establishing the synchronization of the traffic light information by using the traffic signal switching information which can be assumed to have a shorter time which has elapsed after the image capturing.

As mentioned above, because the movement assistance device according to this Embodiment 2 is configured to include the traffic signal data generator 6*c*' that acquires traffic signal switching time data and posts this traffic signal switching time data to the SNS site, the movement assistance device can post time data for configuring traffic signal cycle data even when the movement assistance device cannot acquire traffic signal duration data.

Further, because the movement assistance device according to this Embodiment 2 is configured to include the provided information acquirer 6*d* that establishes the synchronization of traffic light information from the difference between the image capture date and time of the traffic signal switching time data, and the current time, and calculates the remaining lighting time of the light color of the target traffic light, the movement assistance device can offer movement assistance which provides the remaining lighting time of the light color of the target traffic light even when the difference with the current time cannot be acquired by using traffic signal cycle data. Further, also when the image capture date and time of the traffic signal cycle data has passed a fixed time or more, the movement assistance device can reduce the deviation from the actual light color of the traffic light.

Further, because the movement assistance device according to this Embodiment 2 is configured in such away that the provided information acquirer 6*d* acquires the remaining lighting time of the light color of the traffic light by using the traffic signal cycle data generated on the basis of the timely information posted to the SNS site, the movement assistance device can provide relatively-high-accuracy movement assistance also in the case of a traffic light of adaptive control type which changes from moment to moment. Further, because the movement assistance device is configured to calculate the remaining lighting time of the traffic light by using the traffic signal switching time of the traffic light, the movement assistance device can shorten the time required to be able to use the traffic signal cycle data for movement assistance also under an environment in which it is relatively hard to acquire the display duration of a specific traffic signal for a reason such as a small amount of traffic.

Although the configuration which posts all of the generated traffic signal switching time data of a specific traffic signal is shown in above-mentioned Embodiment 2, the movement assistance device can be configured to, when traffic signal cycle data can be acquired, compare the difference between the imaging time included in the traffic signal cycle data and the current time with the difference between the imaging time of the traffic signal switching time data of the above-mentioned specific signal and the current time and post the traffic signal switching time data only when it is determined that the remaining lighting time of the traffic light differs. As a result, unnecessary posts can be reduced, and the load on the SNS site can be reduced.

Embodiment 3.

In this Embodiment 3, a configuration which provides traffic signal switching time data for another moving object or acquires and uses traffic signal switching time data generated by another moving object by using communications between moving objects is shown.

Figure 13:
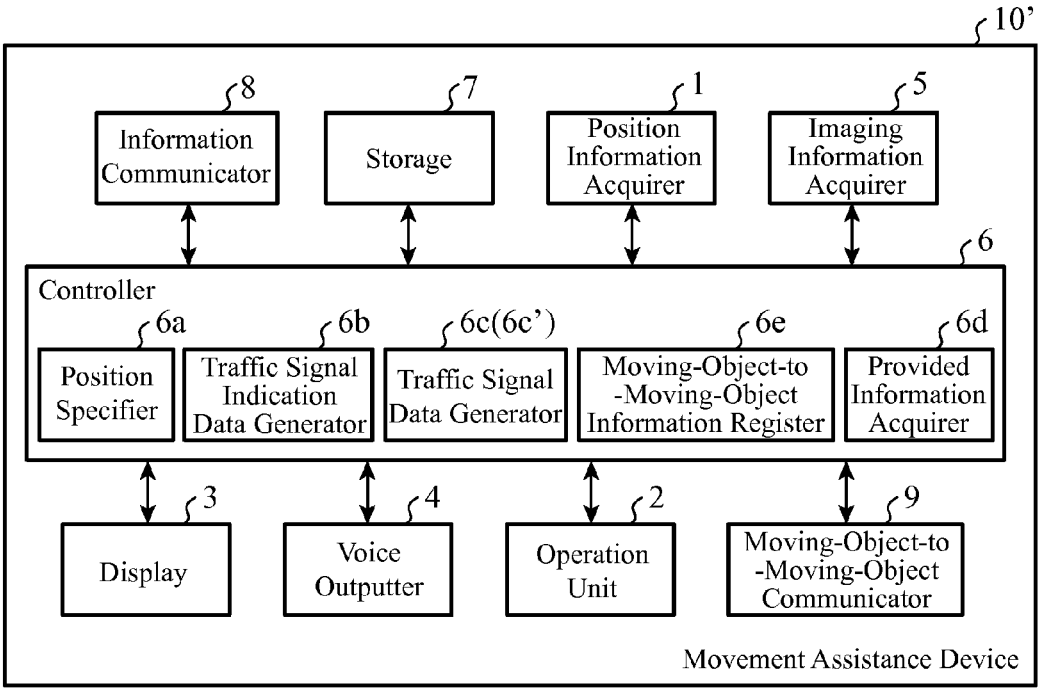
FIG. 13 is a block diagram showing the configuration of a movement assistance device in accordance with Embodiment 3.

FIG. 13 is a block diagram showing the configuration of a movement assistance device in accordance with Embodiment 3 of the present invention.

The movement assistance device 10' in accordance with Embodiment 3 includes a moving-object-to-moving-object communicator 9 in addition to the movement assistance device shown in FIG. 1 or 2, and additionally includes a moving-object-to-moving-object information register 6*e* in a controller 6.

Hereafter, the same components as those of the movement assistance devices 10 in accordance with Embodiments 1 and 2 or like components are denoted by the same reference numerals as those used in Embodiments 1 and 2, and the explanation of the components will be omitted or simplified.

The moving-object-to-moving-object communicator 9 provides traffic signal switching time data generated by traffic signal data generators 6*c* and 6*c*' for other moving objects located in the surroundings thereof. Further, the moving-object-to-moving-object communicator 9 acquires traffic signal switching time data provided therefor from another moving object when the difference with the current time cannot be acquired by using traffic signal cycle data, or when an imaging information acquirer 5 cannot capture an image of the display color of a traffic light as video data. Further, the moving-object-to-moving-object communicator transfers the acquired traffic signal switching time data to other moving objects.

In this case, the moving-object-to-moving-object communicator 9 has a function of acquiring information transmitted and received or transferred via bidirectional communications between the moving object and another moving object. Further, the communications between moving objects refer to a wireless communications technique having a 700 MHz band or a 5.8 GHz bands which is designed in such a way as to be customized for, for example, vehicle communications.

It is appropriate to use, as a communications method, a radio ad hoc network, for example. In ad hoc communications, moving object monitoring devices can communicate with each other by performing routing autonomously, without having to use a fixed network. Further, the ad hoc communications are characterized in that each of those devices plays a role of a router, thereby being able to also perform transfer of information via multi-hop communications. As an example of the ad hoc communications, the use of WAVE (Wireless Access in Vehicle Environments) which is based on "IEEE802.11p" which has been developed specifically for car-to-car communications based on a wireless LAN standard is assumed. By using this standard, the ad hoc communications can be adapted to communications between moving objects travelling at a high speed. Further, because its protocols are closely analogous to those of another wireless LAN standard, switching to a wireless LAN standard, such as existing WiFi, can be performed and the wireless LAN standard can also be used.

Further, because a process of recording traffic signal indication data performed by the movement assistance device 10' in accordance with Embodiment 3 is the same as that of the flow chart shown in FIG. 2 of Embodiment 1, the description and the explanation of the process will be omitted hereafter. Further, because a process of posting traffic signal duration data performed by the movement assistance device 10' in accordance with Embodiment 3 is the same as that of the flow chart shown in FIG. 4 of Embodiment 1, and a process of posting traffic signal switching time data is the same as that of the flow chart shown in FIG. 10 of Embodiment 2, the description and the explanation of the processes will be omitted hereafter. Further, either of the processes of FIGS. 4 and 10 can be used, or both of them can be used together.

Next, the operation of the movement assistance device 10' in accordance with Embodiment 3 will be explained.

Because the process of recording traffic signal indication data is the same as that of the flow chart of FIG. 2 shown in Embodiment 1, the explanation of the process will be omitted hereafter. Further, because the process of posting traffic signal duration data or the process of posting traffic signal switching time data is the same as that of the flow chart shown in FIG. 4 of Embodiment 1 or FIG. 10 of Embodiment 2, the explanation of the process will be omitted hereafter.

Hereafter, a process of registering moving-object-to-moving-object information which is performed in parallel with this traffic signal indication data recording process and this traffic signal duration data/traffic signal switching time data posting process will be explained. For example, the process is a one of, when a large vehicle exists ahead of the moving object and an imaging information acquirer 15 cannot capture an image of the display color of a traffic light as a video, acquiring traffic signal switching time data provided therefor from another moving object via the moving-object-to-moving-object communicator 9.

Figure 14:
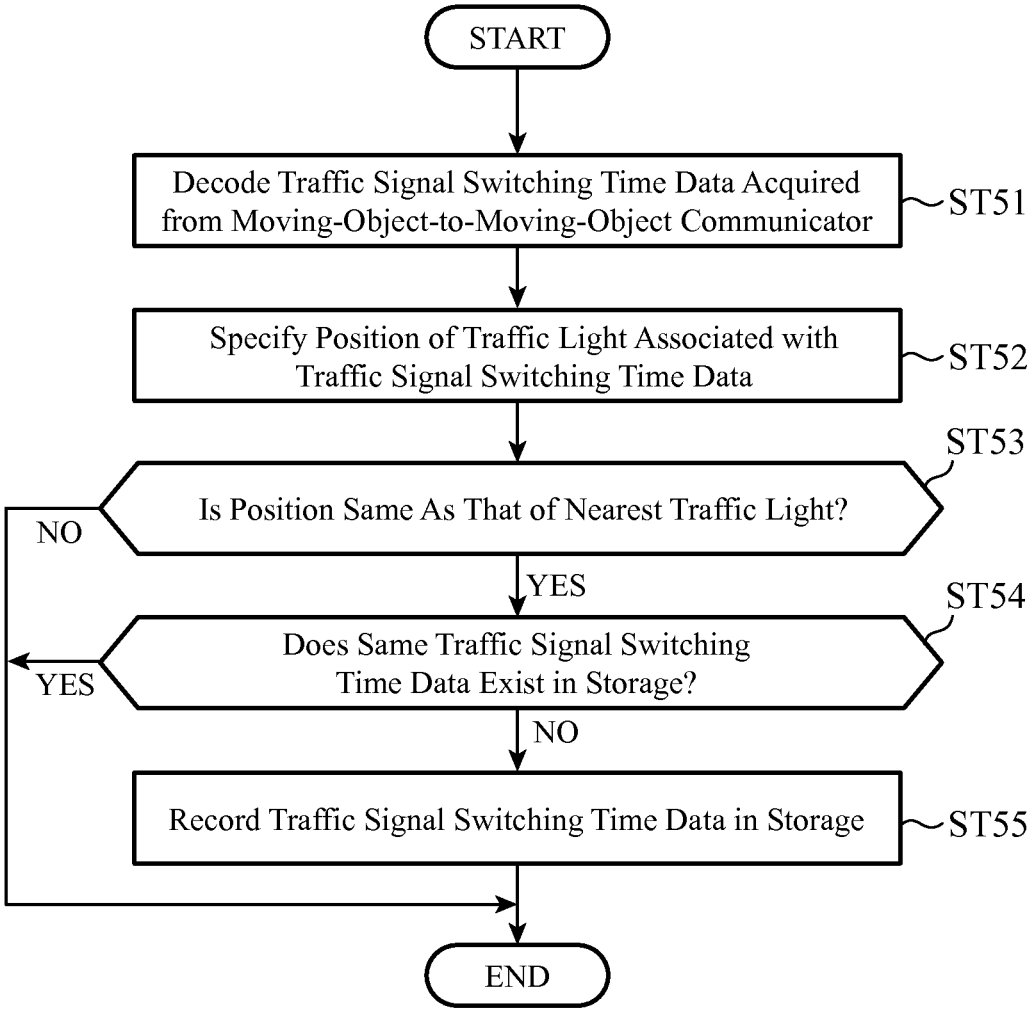
FIG. 14 is a flow chart showing a traffic signal data providing process performed by the movement assistance device in accordance with Embodiment 3.

FIG. 14 is a flow chart showing the moving-object-to-moving-object information registering process performed by the movement assistance device in accordance with Embodiment 3 of the present invention.

The moving-object-to-moving-object information registering process shown in FIG. 14 starts when the moving-object-to-moving-object communicator 9 detects communications with another moving object. Further, it is assumed that each information which constructs the traffic signal switching time data shown in FIG. 12 is included in the moving-object-to-moving-object information.

The movement assistance device decodes and acquires the traffic signal switching time data acquired from the moving-object-to-moving-object information register **6*e* and the moving-object-to-moving-object communicator 9 (step ST51). Next, the movement assistance device specifies the position of the traffic light on a map stored in a storage 7 from either the traffic light ID of the traffic signal switching time data acquired in step ST51 or the position and bearing of the traffic light (step ST52). In addition, the movement assistance device determines whether or not the position of the traffic light specified in step ST52 is the same as that of the traffic light associated with the intersection which the moving object is due to pass immediately afterward (step ST53**).

When the positions of the traffic lights are not the same (when NO in step ST53), the movement assistance device discards the traffic signal switching time data acquired in step ST51, and ends the processing. In contrast, when the positions of the traffic lights are the same (when YES in step ST53), the movement assistance device further determines whether traffic signal switching time data which is the same as the traffic signal switching time data acquired in step ST51 exists in the storage 7 (step ST54). When the same traffic signal switching time data exists (when YES in step ST54), the movement assistance device discards the traffic signal switching time data acquired in step ST51, and ends the processing. In contrast, when the same traffic signal switching time data does not exist (when NO in step ST54), the movement assistance device records the traffic signal switching time data acquired in step ST51 in the storage 7 (step ST55), and ends the processing.

Although the configuration which determines whether the same traffic signal switching time data exists in above-mentioned step ST54 is shown above, the movement assistance device can be configured to cause the storage 7 to store the data as traffic signal switching time data and perform interpolation when, for example, the imaging information acquirer 5 in the controller 6 can determine that it is impossible to capture an image of the light color of the traffic light as video data. As a result, the movement assistance device can prevent the same traffic signal switching time data from being recorded in the storage 7.

The movement assistance device can be configured to, when the imaging information acquirer 5 in the controller 6 similarly can determine that it is impossible to capture an image of the light color of the traffic light as video data, record the data in the storage 7 as mentioned above, and transfer the traffic signal switching time data to other moving objects via the moving-object-to-moving-object communicator 9. As a result, when other moving objects located in the surroundings of the moving object cannot capture an image of the light color of the same traffic signal as video data, the movement assistance device can perform interpolation on the basis of the traffic signal switching time data. As a result, the other moving objects can receive movement assistance even when, for example, a large other moving object exists ahead of those moving objects and also under an environment in which it is difficult to visually recognize the traffic light due to bad weather or the like.

Although it is described above that the traffic signal switching time data posting process is the same as that shown in Embodiment 2, the traffic signal data generator **6*c*' can be configured to generate traffic signal switching time data by referring to the storage 7 in which the traffic signal switching time data acquired by other moving objects are recorded, and post the traffic signal switching time data to a posting site on a network via an information communicator 8**.

Further, in a traffic light information providing process, as shown in FIG. 11, a provided information acquirer **6*d* refers to the storage 7** in which the traffic signal switching time data acquired by other moving objects are recorded, establishes the synchronization of traffic light information from the difference between the image capture date and time and the current time, and acquires the remaining lighting time of the light color of the target traffic light.

As mentioned above, because the movement assistance device according to this Embodiment 3 is configured to include the moving-object-to-moving-object communicator 9 that communicates with another moving object, and the moving-object-to-moving-object information register 6*e* that records the traffic signal switching time data acquired via the moving-object-to-moving-object communicator 9 in the storage 7, the movement assistance device can generate traffic signal switching time data by using the traffic signal switching time data acquired by another moving object, and acquire the remaining lighting time of the light color of the traffic light even when the imaging information acquirer 5 cannot capture the light color of the traffic light as video data.

Further, because the movement assistance device according to this Embodiment 3 is configured to acquire and use the traffic signal switching time data acquired from another moving object located in the surroundings of the moving object by using the moving-object-to-moving-object communicator 9 and the moving-object-to-moving-object information register 6*e*, the movement assistance device can provide relatively-high-accuracy movement assistance also under an environment in which, for example, it is hard to visually recognize the light color existing at the intersection or the like which the moving object is due to pass immediately afterward.

Embodiment 4.

In this Embodiment 4, a configuration which calculates an advisory speed of a vehicle on the basis of the remaining lighting time of each light color of a traffic light acquired from traffic signal cycle data.

Figure 15:
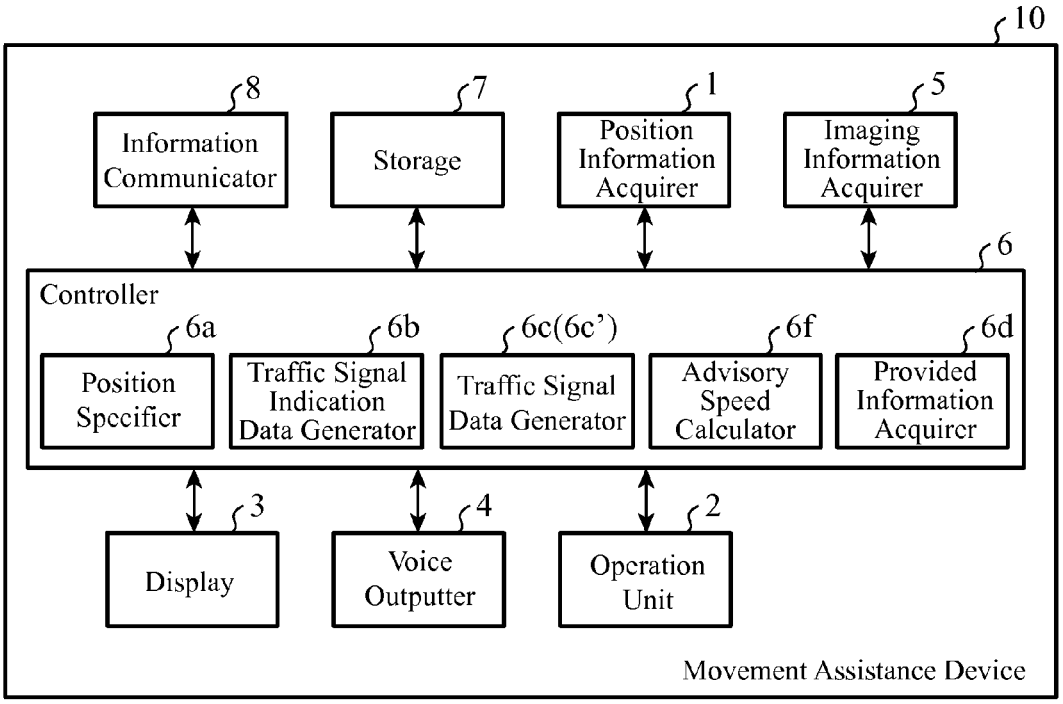
FIG. 15 is a block diagram showing the configuration of a movement assistance device in accordance with Embodiment 4.

FIG. 15 is a block diagram showing the configuration of a movement assistance device in accordance with Embodiment 4 of the present invention. The movement assistance device 10 in accordance with Embodiment 4 additionally includes an advisory speed calculator 6*f* in the controller 6 of the movement assistance device 10 in accordance with Embodiment 1 or 2 shown in FIG. 1 or 9. Hereafter, the same components as those of the movement assistance devices 10 in accordance with Embodiments 1 and 2 or like components are denoted by the same reference numerals as those used in Embodiments 1 and 2, and the explanation of the components will be omitted or simplified.

Further, because a process of recording traffic signal indication data and a process of posting traffic signal duration data or traffic signal switching time data which are performed by the movement assistance device 10 in accordance with Embodiment 4 are the same as those of Embodiments 1 and 2, the description and the explanation of the processes will be omitted.

The advisory speed calculator 6*f* calculates an advisory speed which the moving object should keep until reaching a traffic light on the basis of the remaining lighting time of each light color of the traffic light calculated by using traffic signal cycle data acquired from an SNS server via an information communicator 8.

Next, the process of calculating the advisory speed will be explained with reference to a flow chart of FIG. 16. In the following explanation, the process of calculating only the advisory speed is referred to as an advisory speed providing process.

Figure 16:
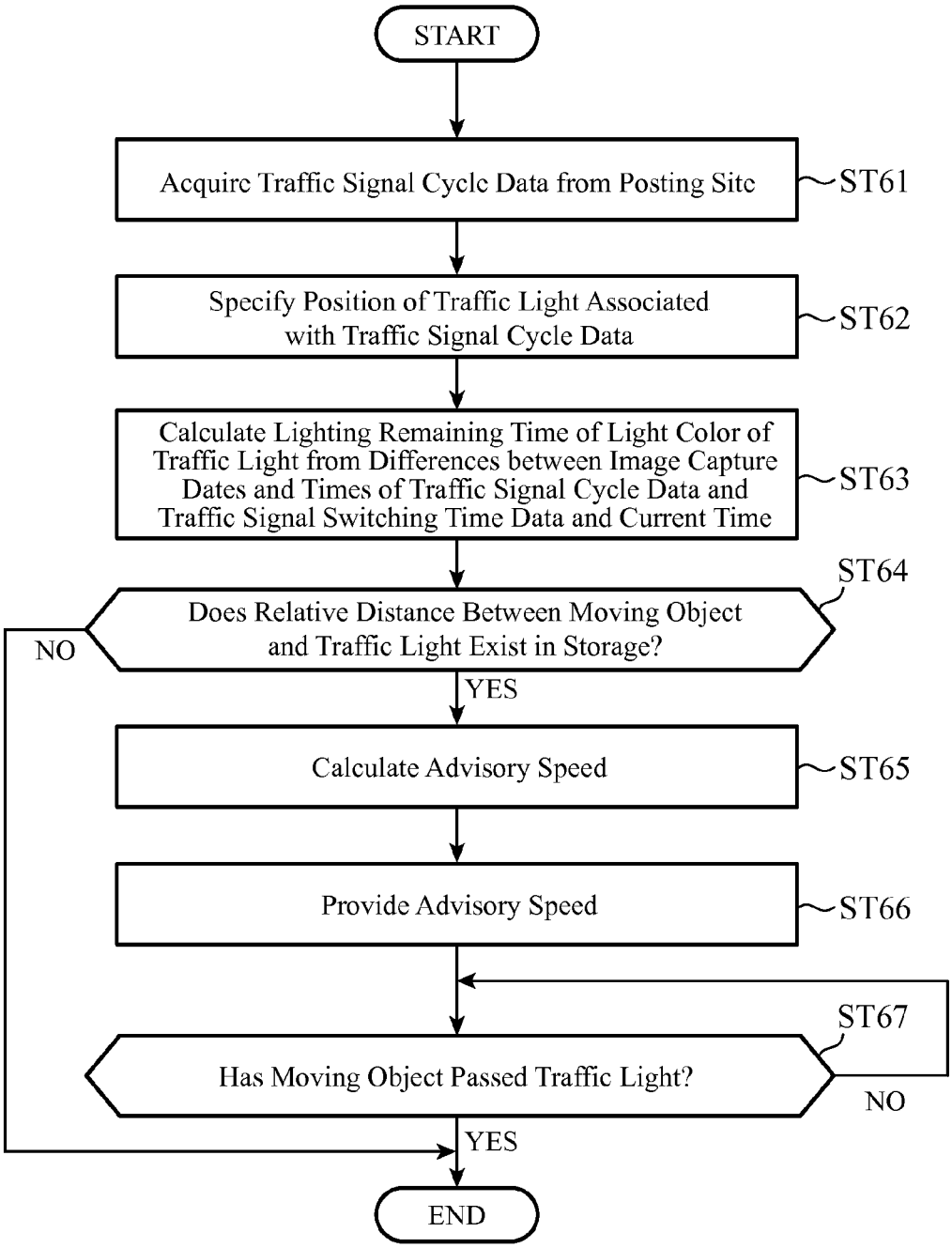
FIG. 16 is a flow chart showing an advisory speed providing process performed by the movement assistance device in accordance with Embodiment 4.

FIG. 16 is a flow chart showing the operation of the advisory speed providing process performed by the movement assistance device in accordance with Embodiment 4 of the present invention.

The advisory speed calculator 6*f* of the controller 6 acquires traffic signal cycle data from a posting site via the information communicator 8 (step ST61). The acquired traffic signal cycle data is configured as shown in, for example, FIG. 7. The provided information acquirer 6*f* specifies the position of a traffic light on a map stored in a storage 7 from either the traffic light ID of the traffic signal cycle data acquired in step ST61 or the position and bearing of the traffic light (step ST62). The provided information acquirer can be configured to, when the position of the traffic light is not the one of the traffic light associated with the intersection which the moving object is due to pass immediately afterward, not acquire the traffic signal cycle data, for example.

On the basis of either the traffic signal cycle data whose acquisition time is the newest or the traffic signal switching time data associated with the same traffic light, among the traffic signal switching time data stored in the storage 7, the advisory speed calculator 6*f* establishes the synchronization of traffic light information from the difference between the image capture date and time of the traffic signal cycle data or the traffic signal switching time data, and the current time, and calculates the remaining lighting time of the light color of the traffic light (step ST63). The advisory speed calculator 6*f* then determines whether or not information about a relative distance between the moving object and the traffic light is stored in the storage 7 (step ST64).

Concretely, the information shows the relative distance between the moving object and the traffic light which is calculated in step ST2 of the flow chart of the FIG. 2 of Embodiment 1, and the traffic light is captured as a video via an imaging information acquirer 5 and whether or not the relative distance information has been acquired is checked. For example, when an obstacle or the like exists ahead of the moving object, the relative distance between the moving object and the traffic light cannot be calculated on the basis of a video. The movement assistance device can be configured to, when the position coordinates of the traffic light located the nearest to the moving object are stored in the storage 7, calculate the relative distance between the two points on the basis of the position coordinates and the position coordinates of the moving object acquired by a position information acquirer 1 and performs interpolation.

When the information about the relative distance between the moving object and the traffic light is not stored (when NO in step ST64), the movement assistance device ends the processing. In contrast, when the information about the relative distance between the moving object and the traffic light is stored (when YES in step ST64), the advisory speed calculator 6*f* calculates an advisory speed recommended on the basis of the remaining lighting time calculated in step ST63, the relative distance information stored in the storage 7, and the speed information of the moving object acquired by the position information acquirer 1 (step ST65). The advisory speed calculator 6*f* provides the advisory speed calculated in step ST65 for the moving object or a passenger in the moving object via a display 3 and a voice outputter 4 (step ST66). After that, the advisory speed calculator 6*f* determines whether the moving object has passed the traffic light on the basis of both the position information about the moving object inputted from the position information acquirer 1, and the map information stored in the storage 7 (step ST67). When the moving object has not passed the traffic light (when NO in step ST67), the advisory speed calculator continues the determining process of step ST67. In contrast, when the moving object has passed the traffic light (when YES in step ST67), the advisory speed calculator ends the processing.

A method of calculating the advisory speed will be shown in greater detail.

For example, when the current light color of the traffic light is "green" and the remaining lighting time is $t_{b1}$ [sec], the durations of "yellow" and "red" are $t_{y1}$ [sec] and $t_{r1}$ [sec], respectively, and the speed is $v_1$ [m/sec] and the relative distance is $x_1$ [m], an advisory speed region $v_{a1}$ [m/sec] which enables the moving object to reach the position of the traffic light in a state in which the light color is "green" can be calculated by using the following equation (1) or (2).

$$v_{a1} \geq \frac{x_1}{t_{b1}} \text{[m/sec]} \tag{1}$$

$$v_{a1} \leq \frac{x_1}{t_{b1} + t_{y1} + t_{r1}} \text{[m/sec] (constant speed model)} \tag{2}$$

It is assumed that the storage 7 stores parameters $v_{min}$ [m/sec] and $v_{max}$ [m/sec] which define a range of effective advisory speeds, and a maximum speed which satisfies the following effective speed condition: $v_{min} \leq v_{a1} \leq v_{max}$ is selected as the advisory speed from the advisory speed region calculated using the above-mentioned equation (1) or (2).

In this case, it is desirable that $v_{max}$ [m/sec] is a restricted speed on the moving route along which the moving object is travelling. When the restricted speed information can be acquired on the basis of road map data which the storage 7 has, the restricted speed can be preset in such a way that it can be used for the above-mentioned determination.

Further, when the storage 7 also stores a deceleration $d_1$ [m/sec$^2$] and an acceleration $a_1$ [m/sec$^2$], the advisory speed calculator calculates the advisory speed ($d_1>0$, $a_1>0$) by also taking the acceleration and deceleration of the moving object into consideration. For example, when being unable to determine the advisory speed satisfying the above-mentioned effective speed condition, the advisory speed calculator determines the advisory speed with which it is assumed that the moving object will stop at the position of the traffic signal on the basis of the following equation (3).

$$v_{a1} = v_1 \text{[m/sec]}\left(x_1 \geq \frac{v_1^2}{2d_1}\right),\ v_{a1} = \sqrt{2d_1x_1} \text{[m/sec]}\left(x_1 \leq \frac{v_1^2}{2d_1}\right) \tag{3}$$

In this case, it can be assumed that when grade information is included in the map data stored in the storage 7, the above-mentioned original speed and acceleration are corrected. For example, when the angle of the grade at a deceleration or acceleration position is θ and the gravitational acceleration is g, the grade acceleration A [m/sec$^2$], the deceleration after grade correction $d_2$ [m/sec$^2$], and the acceleration after grade correction $a_2$ [m/sec$^2$] can be determined by using the following equations (4) to (6) ($d_2>0$, $a_2>0$).

$$A = G^* \sin\theta \approx G^* \tan\theta \tag{4}$$

$$a_2 = a_1 - A[m/\sec^2],\ d_2 = d_1 + A[m/\sec^2] \text{(up grade)} \tag{5}$$

$$a_2 = a_1 + A[m/\sec^2],\ d_2 = d_1 - A[m/\sec^2] \text{(down grade)} \tag{6}$$

Figure 17:
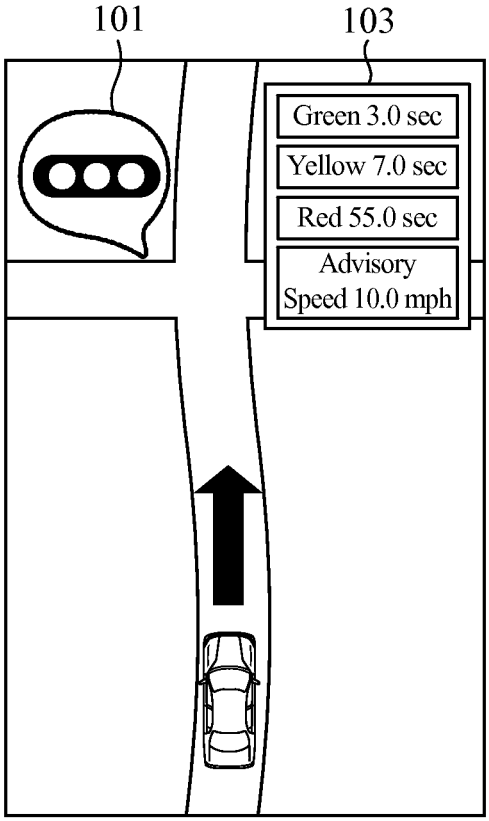
FIG. 17 is a diagram showing a display example at the time of traffic signal synchronization in the movement assistance device in accordance with Embodiment 4.

Further, while the process of providing the advisory speed for the moving object or a passenger in the moving object in above-mentioned step ST66 is shown above, an example of a displaying method in the case of displaying the advisory speed on the display 3 is shown in FIG. 17. For example, when it is assumed that the traffic signal cycle consists of green, yellow, and red, a display area 103 showing the remaining lighting time until each light color and the determined advisory speed is displayed as shown in FIG. 17. It is assumed that as the display in the display area 103, either a value which is calculated by decrementing the remaining lighting time from moment to moment with the passage of time or a value which is calculated by using the above-mentioned value is provided. Further, when the light color of the traffic signal changes, the display positions of the light colors in the display area 103 of FIG. 17 are changed in such a way that they are aligned in display order after the change.

The unit of the advisory speed can be always selected from at least two units: mph (=mile per hour) and km/h (=kilometer per hour) via an operation unit 2, and this selected choice is stored in the storage 7. The advisory speed calculator **6*f* calculates the advisory speed according to the unit stored in the storage 7**.

As mentioned above, because the movement assistance device according to this Embodiment 4 is configured to include the advisory speed calculator **6*f*** that calculates the advisory speed of the moving object on the basis of both the remaining lighting time of the light color of the traffic light, which is calculated from the traffic signal cycle data, and the information about the relative distance between the moving object and the traffic light, the movement assistance device makes it possible to recognize the recommended moving speed without making a request of the moving object to perform an arbitrary judgment. In addition, because the movement assistance device makes it possible to travel while recognizing the acceleration and deceleration timings from a change in the advisory speed, the movement assistance device can prevent useless acceleration and deceleration. Further, when the deceleration and the acceleration are set up in such a way as to cause a so-called engine brake and a smooth press on the accelerator, respectively, a fuel consumption reduction effect can also be expected in addition to the above-mentioned advantages.

Although the configuration which applies the advisory speed calculator **6*f* to the configuration in accordance with Embodiment 1 or 2 is shown in above-mentioned Embodiment 4, the advisory speed calculator 6*f*** can be alternatively applied to the configuration in accordance with Embodiment 3.

Embodiment 5.

The movement assistance device shown in any of above-mentioned Embodiments 1 to 4 can be applied to a navigation device for moving objects including vehicles, railroads, ships, or airplanes, a server of a movement assistance system, and a server of a navigation system. The movement assistance device can also be applied to an application for movement assistance systems, an application for navigation systems, etc. which are installed in mobile information terminals, such as smart phones, tablet PCs, and mobile phones.

Figure 18:
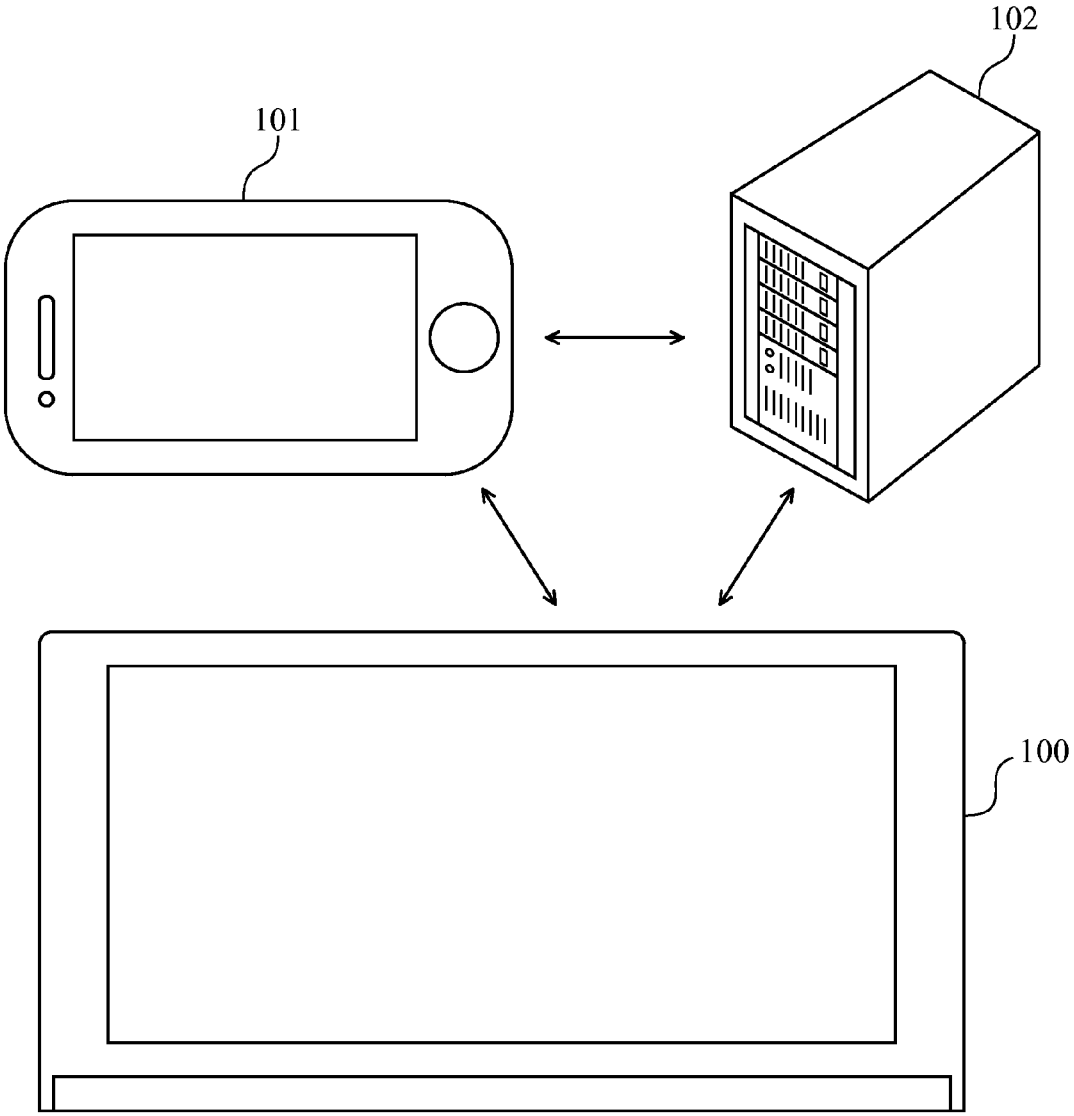
FIG. 18 is a diagram showing an outline of a movement assistance system in accordance with Embodiment 5.

FIG. 18 is a diagram showing an outline of a movement assistance system in accordance with Embodiment 5 of the present invention. In the movement assistance system shown in FIG. 14, an information device 100 mounted in a moving object performs a movement assistance process in cooperation with at least one of a mobile information terminal 101, such as a smart phone, and a server device 102. Hereafter, an example of the configuration of the movement assistance system will be explained.

First, a case in which the server device 102 performs a process of providing movement assistance information and displaying the movement assistance information on the information device 100, i.e., a case in which the information device 100 functions as a display unit in cooperation with the server device 102 having a movement assistance information providing function will be explained.

In this configuration, there can be considered a case in which the information device 100 communicates directly with the server device 102, or the information device 100 communicates with the server device 102 via the mobile information terminal 101. The server device 102 functions as a movement assistance device provided with the controller 6 shown in any one of above-mentioned Embodiments 1 to 4. Further, the information device 100 functions as a display unit provided with at least a display 3 for providing the user with the movement assistance provided information provided by the server device 102. Also when the system is constructed in this way, the same advantages as those provided by any one of above-mentioned Embodiments 1 to 4 can be provided.

Next, a case in which the mobile information terminal 101 performs a process of providing movement assistance information in cooperation with the server device 102, and displaying the movement assistance information on the information device 100 will be explained.

In this configuration, there can be considered a case in which the information device 100 communicates with the server device 102 via the mobile information terminal 101. An application for the mobile information terminal 101 is provided with the functions of the controller 6 shown in any one of above-mentioned Embodiments 1 to 4, and performs a movement assistance information providing process in cooperation with the server device 102. Further, the information device 100 functions as a display unit provided with at least the display 3 for providing the user with the movement assistance information provided by the mobile information terminal 101 and the server device 102. Also when the system is constructed in this way, the same advantages as those provided by any one of above-mentioned Embodiments 1 to 4 can be provided.

While the invention has been described in its preferred embodiments, it is to be understood that an arbitrary combination of two or more of the above-mentioned embodiments can be made, various changes can be made in an arbitrary component in accordance with any one of the above-mentioned embodiments, and an arbitrary component in accordance with any one of the above-mentioned embodiments can be omitted within the scope of the invention.

INDUSTRIAL APPLICABILITY

As mentioned above, the movement assistance device in accordance with the present invention can be applied to a navigation device mounted in a moving object, such as a vehicle, a server of an assistance information providing system, an application for mobile terminals, such as smart phones, tablet PCs, and mobile phones, and so on, and can implement movement assistance using a post service provided by an SNS site or the like.

EXPLANATIONS OF REFERENCE NUMERALS

1 position information acquirer, 2 operation unit, 3 display, 4 voice outputter, 5 imaging information acquirer, controller, 6*a* position specifier, 6*b* traffic signal indication data generator, 6*c* traffic signal data generator, 6*d* provided information acquirer, 6*e* moving-object-to-moving-object information register, 6*f* advisory speed calculator, 7 storage, 8 information communicator, 9 moving-object-to-moving-object communicator, 10, 10' movement assistance device.

The invention claimed is:

1. A movement assistance device that is mounted in or carried by a moving object and includes an information communicator connected to an SNS server that provides an SNS (Social Networking Service) via a network, and an information outputter that provides information which is acquired via said information communicator, said movement assistance device comprising:

a provided information acquirer that acquires, via said information communicator, traffic signal cycle data in which traffic signal data comprised of identification information of a traffic light, which is stored in said SNS server, and an image capture date and time and a lighting duration time of said traffic light is organized for each light color pattern of said traffic light, and that specifies, from the identification information of said traffic light of said traffic signal cycle data, a traffic light which the moving object will pass, and calculates a remaining lighting time which is a remaining time which will elapse until lighting of each light color of said specified traffic light is ended from both a time difference between an image capture date and time of each light color of said traffic signal cycle data and a current time, and the lighting duration time of said traffic signal cycle data;

an imaging information acquirer that captures an image of an area ahead of said moving object to acquire video data;

a traffic signal data generator that generates switching traffic signal data; and a moving object to moving object information register that acquires said switching traffic signal data provided from another moving object;

wherein said information outputter provides said remaining lighting time calculated by said provided information acquirer; and wherein when said imaging information acquirer determines that no video data including said traffic light can be acquired, said moving object to moving object information register acquires said switching traffic signal data provided from said another moving object.

2. The movement assistance device according to claim 1, wherein said movement assistance device comprises: an imaging information acquirer that captures an image of an area ahead of said moving object to acquire video data; a position information acquirer that acquires position information about said moving object; a position specifier that specifies a position of a traffic light included in the video data acquired by said imaging information acquirer on a basis of the position information about said moving object acquired by said position information acquirer; a traffic signal indication data generator that specifies a light color of the traffic light included in the video data acquired by said imaging information acquirer, and that generates traffic signal indication data comprised of said specified light color, identification information showing the position of the traffic light specified by said position specifier, and an image capture date and time showing a date and time when said imaging information acquirer captures an image of said traffic light; and a traffic signal data generator that analyzes the traffic signal indication data generated by said traffic signal indication data generator and calculates said lighting duration time showing a time which will elapse after a start of lighting of said specified light color until an end of the lighting, and that generates said traffic signal data comprised of the identification information showing the position of the traffic light specified by said position specifier, and the image capture date and time and said lighting duration time of said specified light color, and wherein said information communicator transmits said traffic signal data generated by said traffic signal data generator to said SNS server connected thereto.

3. The movement assistance device according to claim 2, wherein when the image capture date and time of the traffic signal data generated by said traffic signal data generator is newer than the image capture date and time of the traffic signal data which constructs said acquired traffic signal cycle data, said information communicator transmits the traffic signal data generated by said traffic signal data generator to said SNS server.

4. The movement assistance device according to claim 2, wherein when the lighting duration time which constructs said traffic signal data generated by said traffic signal data generator differs from the lighting duration time of said traffic signal data which constructs said acquired traffic signal cycle data, said information communicator transmits said traffic signal data generated by said traffic signal data generator to said SNS server.

5. The movement assistance device according to claim 2, wherein said movement assistance device comprises an advisory speed calculator that acquires said traffic signal cycle data via said information communicator, specifies the traffic light which the moving object will pass from the identification information of the traffic light of said acquired traffic signal cycle data, calculates said remaining lighting time of each light color of said specified traffic light from both the time difference between the image capture date and time of each light color of said traffic signal cycle data and the current time, and the lighting duration time of said traffic signal cycle data acquires information about a relative distance between said traffic light and said moving object from both the position information about said traffic light specified by said position specifier and the position information about the moving object acquired by said position information acquirer, and calculates an advisory speed of said moving object from speed information about the moving object acquired by said position information acquirer, said calculated remaining lighting time, and said acquired relative distance information.

6. The movement assistance device according to claim 1, wherein said movement assistance device comprises: a position information acquirer that acquires position information about said moving object; a position specifier that specifies a position of a traffic light included in the video data acquired by said imaging information acquirer on a basis of the position information about said moving object acquired by said position information acquirer; a traffic signal indication data generator that specifies a light color of the traffic light included in the video data acquired by said imaging information acquirer, and that generates traffic signal indication data comprised of said specified light color, identification information showing the position of the traffic light specified by said position specifier, and an image capture date and time showing a date and time when said imaging information acquirer captures an image of said traffic light; and said traffic signal data generator that analyzes the traffic signal indication data generated by said traffic signal indication data generator and calculates a lighting switching time required for the traffic light to switch from said specified first light color to a second light color, and that generates switching traffic signal data comprised of the identification information showing the position of the traffic light specified by said position specifier, the image capture date and time of said specified light color, and said lighting switching time, and wherein said information communicator transmits said switching traffic signal data generated by said traffic signal data generator to said SNS server connected thereto and said provided information acquirer acquires said traffic signal cycle data having said lighting duration time which said SNS server generates on a basis of said switching traffic signal data.

7. The movement assistance device according to claim 6, wherein said movement assistance device comprises a storage that records said switching traffic signal data generated by said traffic signal data generator therein, and wherein said provided information acquirer calculates said remaining lighting time of said specified traffic light from both a time difference between the image capture date and time of the switching traffic signal data recorded in said storage and the current time, and the lighting switching time of said switching traffic signal data.

8. The movement assistance device according to claim 7, wherein said movement assistance device comprises: a moving object to moving object communicator that performs a communication connection between said moving object and another moving object; and a moving object to moving object information register that acquires said switching traffic signal data provided from the another moving object via said moving object to moving object communicator, and wherein said storage records said switching traffic signal data acquired by said moving object to moving object information register therein.

9. The movement assistance device according to claim 6, wherein said movement assistance device comprises: a moving object to moving object communicator that performs a communication connection between said moving object and said another moving object; and said moving object to moving object information register acquires said switching traffic signal data provided from said another moving object via said moving object to moving object communicator, and wherein said information communicator transmits said switching traffic signal data acquired by said moving object to moving object information register to the SNS server connected thereto.

10. The movement assistance device according to claim 6, wherein when the image capture date and time of the switching traffic signal data generated by said traffic signal data generator is newer than the image capture date and time of the traffic signal data which constructs said acquired traffic signal cycle data, said information communicator transmits the switching traffic signal data generated by said traffic signal data generator to said SNS server.

11. The movement assistance device according to claim 10, wherein said moving object to moving object information register transfers said acquired switching traffic signal data to the another moving object via said moving object to moving object communicator.

12. The movement assistance device according to claim 6, wherein when said remaining lighting time calculated from both the time difference between the image capture date and time of said switching traffic signal data, which is generated by said traffic signal data generator, and the current time, and the lighting switching time of said switching traffic signal data differs from said remaining lighting time which the said provided information acquirer calculates on a basis of said traffic signal cycle data, said information communicator transmits said switching traffic signal data generated by said traffic signal data generator to said SNS server.

13. The movement assistance device according to claim 6, wherein said movement assistance device comprises an advisory speed calculator that acquires said traffic signal cycle data via said information communicator, specifies the traffic light which the moving object will pass from the identification information of the traffic light of said acquired traffic signal cycle data, calculates said remaining lighting time of each light color of said specified traffic light from both the time difference between the image capture date and time of each light color of said traffic signal cycle data and the current time, and the lighting duration time of said traffic signal cycle data, acquires information about a relative distance between said traffic light and said moving object from both the position information about said traffic light specified by said position specifier and the position information about the moving object acquired by said position information acquirer, and calculates an advisory speed of said moving object from speed information about the moving object acquired by said position information acquirer, said calculated remaining lighting time, and said acquired relative distance information.

14. A movement assistance method of connecting to an SNS server that provides an SNS (Social Networking Service) via a network, and providing acquired information for a moving object, wherein a provided information acquirer includes:

acquiring traffic signal cycle data in which traffic signal data comprised of identification information of a traffic light, which is stored in said SNS server, and an image capture date and time and a lighting duration time of said traffic light is organized for each light color pattern of said traffic light;

specifying, from said traffic signal cycle data, a traffic light which a moving object will pass;

calculating a remaining lighting time which is a remaining time which will elapse until lighting of each light color of said specified traffic light is ended from both a time difference between an image capture date and time of each light color of said traffic signal cycle data and a current time, and the lighting duration time of said traffic signal cycle data;

capturing an image of an area ahead of said moving object to acquire video data;

generating switching traffic signal data;

acquiring said switching traffic signal data provided from another moving object; and providing said remaining lighting time for said moving object;

wherein when a determination is made that no video data including said traffic light can be acquired, said switching traffic signal data provided from said another moving object is acquired.

* * * * *